US010294685B2

(12) United States Patent
Maggeni et al.

(10) Patent No.: US 10,294,685 B2
(45) Date of Patent: May 21, 2019

(54) POOL CLEANING ROBOT

(71) Applicant: MAYTRONICS LTD., Kibutz Yizrael (IL)

(72) Inventors: Yohanan Maggeni, Ilaniya (IL); Boaz Ben Dov, Ram On (IL)

(73) Assignee: MAYTRONICS LTD., Kibbutz Yizrael (IL)

( * ) Notice: Subject to any disclaimer, the term of this patent is extended or adjusted under 35 U.S.C. 154(b) by 327 days.

(21) Appl. No.: 15/230,427

(22) Filed: Aug. 7, 2016

(65) Prior Publication Data

US 2017/0058546 A1 Mar. 2, 2017

Related U.S. Application Data

(63) Continuation of application No. 14/538,884, filed on Nov. 12, 2014, now Pat. No. 9,410,338, which is a continuation of application No. 14/023,544, filed on Sep. 11, 2013, now Pat. No. 9,145,699.

(30) Foreign Application Priority Data

Sep. 11, 2012 (IL) ..... 221877

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
See application file for complete search history.

(56) References Cited

U.S. PATENT DOCUMENTS 5,285,547 A * 2/1994 Sebor ..... E04H 4/1654 137/526

* cited by examiner

*Primary Examiner* — Shay Karls
(74) *Attorney, Agent, or Firm* — Reches Patents

(57) ABSTRACT

A cleaning robot that includes a housing having a front portion, a rear portion, a door and a hinge; wherein the door is pivotally connected to the rear portion of the housing via the hinge; wherein the rear portion comprises a rear opening; wherein the door is arranged to move between a closed position in which the door substantially closes the rear opening and an open position in which the door does not close the rear opening; wherein the door comprises a floating element or is coupled to a floating element, wherein the floating element is positioned and shaped to induce the door to move to the closed position when the cleaning robot is submerged in fluid and to remain in an open position when out of a pool and positioned in a horizontal position.

19 Claims, 29 Drawing Sheets

2700

POOL CLEANING ROBOT

CROSS REFERENCE TO RELATED APPLICATIONS

This application is a continuation of U.S. patent application Ser. No. 14/538,884 filing date Nov. 12, 2014 which is a continuation of U.S. patent application Ser. No. 14/023544 filing date Sep. 11, 2013 now U.S. Pat. No. 9,145,699 which claims priority from Israeli patent application serial number 221877 filing date Sep. 11, 2012—all patent applications and patents being incorporated herein by reference

BACKGROUND

Cleaning robots are known in the art. Various cleaning robots are manufactured by Maytronics Ltd. of Israel and represent the state of the art of cleaning robots.

A cleaning robot is expected to clean the pool by brushing the surfaces of the pool and filtering the fluid of the pool by removing foreign particles from that fluid. The cleaning robot can be requested to move along various paths and change its direction when cleaning the pool.

There is a growing need to provide an efficient cleaning robot.

SUMMARY

According to an embodiment of the invention a cleaning robot may be provided and may include a housing having a front portion, a rear portion, a door and a hinge. The door may be pivotally connected to the rear portion of the housing via the hinge. The rear portion may include a rear opening. The door is arranged to move between a closed position in which the door substantially closes the rear opening and an open position in which the door does not close the rear opening. The door may include a floating element or is coupled to a floating element. The floating element may be positioned and shaped to induce the door to move to the closed position when the cleaning robot is submerged in fluid and to remain in an open position when the cleaning robot is out of the water in a horizontal position.

At least a portion of the floating element may be closer to the front portion of the housing than the hinge.

A center of flotation of the door may be closer to the front portion of the housing than the hinge.

The door may be coupled to the floating element and wherein a center of flotation of a combination of the door and the floating element may be closer to the front portion of the housing than the hinge.

The door may be made of a floating material.

The door may be induced to move to an open position when the cleaning robot may be pulled out from the fluid and the front portion of the housing may be positioned above the rear portion of the housing.

The cleaning robot may include a limiting element for limiting an extent of movement of the door between the open and closed positions.

The limiting element may be a rear cleaning unit.

The limiting element may be arranged to limit a movement of the door.

A range of movement of the door between the open and closed positions may or may not exceed ten centimeters.

A range of movement of the door between the open and closed positions may or may not exceed a centimeter.

The door may have a curved cross section.

A width of the door may or may not exceed half a width of the cleaning robot.

A width of the door may or may not exceed one fourth of a width of the cleaning robot.

The cleaning robot may include a handle that may be connected to the front portion of the housing.

The door may be coupled to the rear portion of the housing only by the hinge.

The cleaning robot may include a drive motor that may be arranged to rotate multiple rotating element, at least some of which are arranged to contact a surface of the pool; an impeller; a pump motor that may be arranged to rotate the impeller; a filtering unit; and a brushing element; wherein the pump motor, the drive motor and the impeller are substantially closer to the front portion of the housing than to a rear portion of the housing.

A distance of each one of the pump motor, drive motor and the impeller from the front portion of the housing may be at least 20% smaller than a corresponding distance to the rear portion of the housing.

According to an embodiment of the invention a cleaning robot may be provided that may include a housing for a cleaning robot, the housing may include a front portion, a rear portion, a door; and a hinge. The door may be pivotally connected to the rear portion via the hinge. The rear portion may include a rear opening. The door may be arranged to move between a closed position in which the door substantially closes the rear opening and an open position in which the door does not close the rear opening. The door may include a floating element or may be coupled to a floating element. The floating element may be positioned and shaped to induce the door to move to the closed position when the cleaning robot may be submerged in fluid.

According to an embodiment of the invention a cleaning robot may be provided and may include a drive motor that is arranged to rotate multiple rotating elements, at least some of which are arranged to contact a surface of the pool; an impeller; a pump motor that is arranged to rotate the impeller; a housing that encloses the drive motor, the pump motor and the impeller; a filtering unit; and a brushing element. The pump motor, the drive motor and the impeller are substantially closer to a front portion of the housing than to a rear portion of the housing.

A distance of each one of the pump motor, drive motor and the impeller from the front edge of the housing is at least 20% smaller than a corresponding distance to the rear edge of the housing.

Any combination of any of these cleaning robots or any of their components can be provided.

Any of these cleaning robots can be free of floating elements or may include floating elements.

Any of these cleaning robots can be arranged to clean a pool. A method is provided and may include placing a cleaning robot (as illustrated in the specification) within a pool and allowing the robot to clean the pool while moving through the pool.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 2-4A illustrate a front brushing unit and various interfaces according to an embodiment of the invention;

Figure 1:
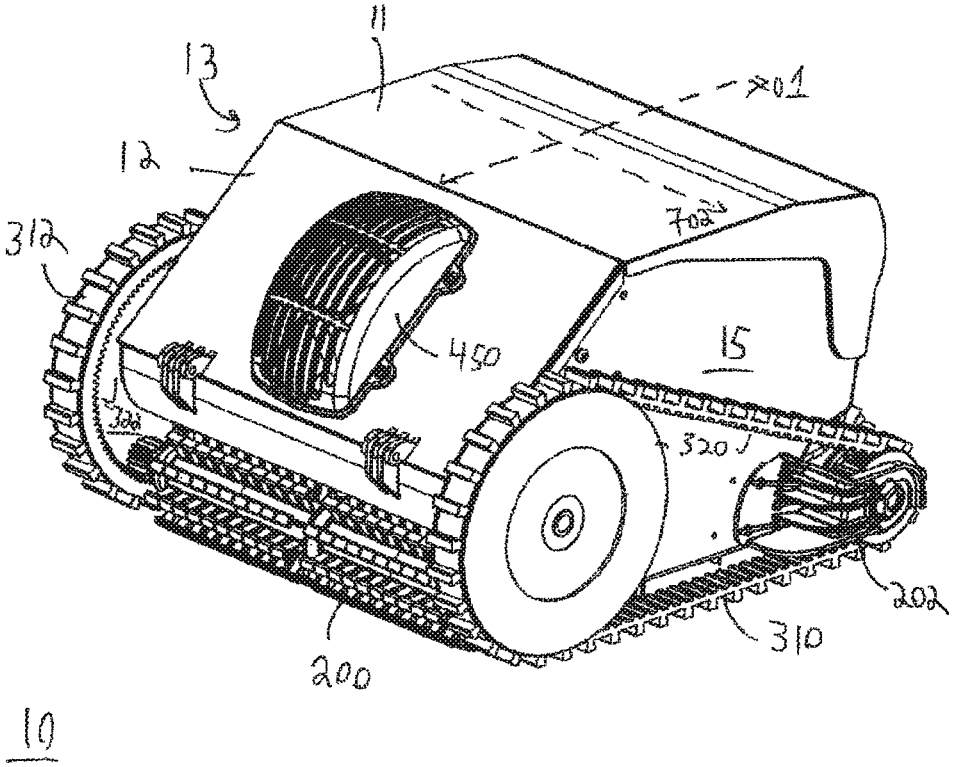
FIG. 1 illustrates a cleaning robot according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The terms axis and axel are used in an interchanging manner. The term pool means any element that is capable of containing fluid.

FIG. 1 illustrates a cleaning robot 10 according to an embodiment of the invention.

The cleaning robot 10 includes a housing 13 that includes a cover 11 that is pivotally connected to a main body 12 of the housing 13.

The cleaning robot 10 may interface a surface of a pool (to be cleaned by the robot) by two tracks—right track 310 and left track 312.

Right track 310 contacts rear right wheel 320 and a right side of a front brushing unit 200. Especially, inner teeth (not shown) of right track 310 match teeth of track receiving portion 220 that is positioned at the right side of the front brushing unit 200 and teeth (not shown) of a track receiving portion of the rear right wheel 320.

Left track 312 contacts rear left wheel 322 and a left side of front brushing unit 200. Especially, inner teeth of left track 312 match teeth of a track receiving portion (not shown) positioned at the left side of the front brushing unit 220 and teeth (not shown) of a track receiving portion of the rear left wheel 322.

The external teeth of each of tracks 310 and 312 may contact the surface of the pool.

FIG. 1 also illustrates a right sidewall 15 of the housing 13 and a multiple-opening cover portion 450 that is positioned at a center of a rear panel 14 of the housing 13 and includes a right opening 452, a left opening 454 and a central opening 456—the central opening 456 may include an array of narrow and elongated openings that have a curved cross section.

FIG. 1 also illustrate a longitudinal axis 701 that is parallel to tracks 310 and 312 and a traverse axis 702 that is normal to the longitudinal axis 701, each of these axes is illustrates as being located at the center of the cleaning robot 10.

Reciprocation of Cleaning Element

According to an embodiment of the invention a cleaning robot may include a drive motor; a housing that encloses the drive motor; a brushing element; and a transmission connected between the brushing element and the drive motor, the transmission may be arranged to convert a rotary movement induced by the drive motor to a combination of (a) a rotary movement of the brushing element about a brushing element axis, and (b) a reciprocal movement of the brushing element in parallel to the brushing element axis.

The brushing element axis may be parallel to a traverse axis of the housing.

The transmission may include a converter arranged to convert the rotary movement induced by the drive motor to the reciprocal movement. The rotary movement occurs within a rotary movement plane that is oriented in relation to the brushing element axis.

Figure 2:
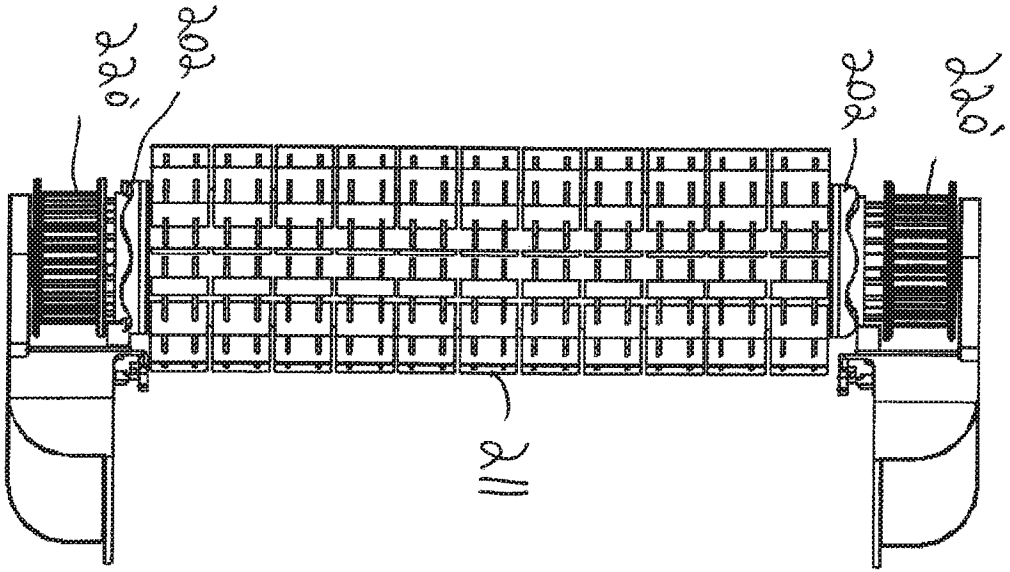
Figure 3:
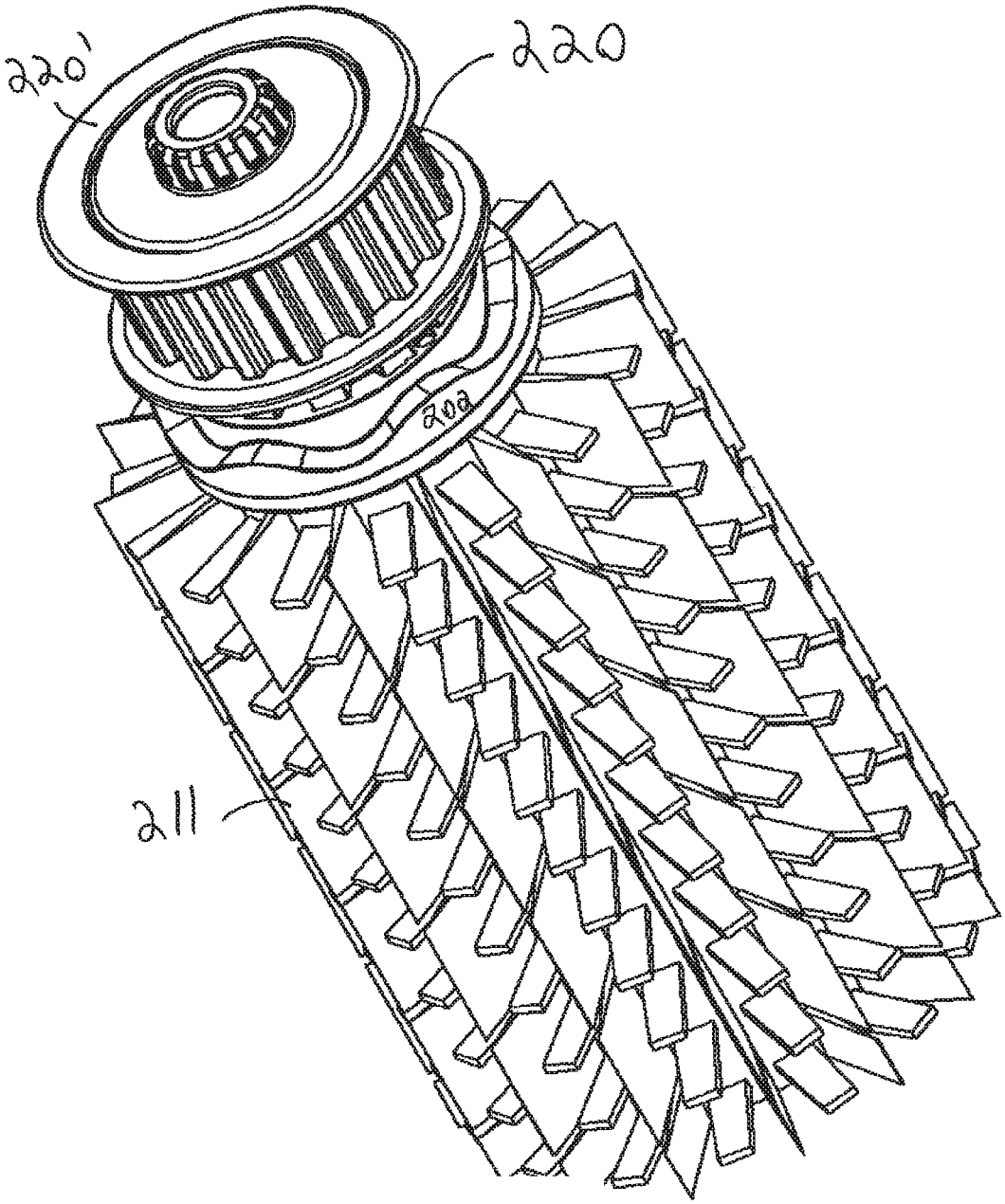

Referring to FIG. 2, the converter is illustrated as including (a) a first interface 202 that has a non-flat surface and may be arranged to be rotated by the rotary movement: (b) a second interface 201 that is positioned at fixed distance (distance of zero or more) from the rotary movement plane.

The second interface 201 may be arranged to contact the first interface 202 and to force the first interface 202 to reciprocate as a result of the rotary movement. The second interface 201 can have a cylindrical shape and (in order to reduce friction) may rotate about an axis that is parallel to the rotary movement plane.

The non-flat surface of the first interface 202 may have a sinusoidal cross section then when contacting the second interface 201 causes the front brushing element 211 to reciprocate.

FIG. 2 illustrates one side (for example a left side) of the front brushing wheel and one side of the first interface 202.

The second side of the first interface 202 (that is proximate to the second side of the brushing unit 220) has a non-flat surface (for example a right side non-flat surface) that corresponds to the flat surface illustrated in FIG. 2—so that at any orientation of the brushing wheel both non-flat surfaces induce a reciprocal movement to the same direction.

Thus, referring to the example set fourth in FIG. 2, the right non-flat surface of the first interface 202 has the same sinusoidal cross section wherein peaks of the sinusoidal cross section of the right non-flat surface are located at the same location (orientation wise) to corresponding minimal points of the sinusoidal cross section of the left non-flat surface.

Referring to FIGS. 2-4A—the front brushing element 211 is connected to the first interface 202. The first interface 202 is connected to a rotating element 212 to facilitate a reciprocal movement of the first interface 202 and the front brushing element 211 in relation to the rotating element 212.

The rotating element 212 may include, for example, radially extending protrusions 212' that may be shaped as radially extending bars while the first interface 202 may have matching grooves (not shown) that allow reciprocal movement of the first interface 202 in relation to the rotating element 212. Alternatively—rotating element 212 may include grooves that match protrusions of the first interface 202. Alternatively—the rotating element 212 may have grooves and protrusions and the first interface 202 may include matching protrusions and grooves.

Although not shown there should be locking elements that prevent a detachment of the rotating element 212 from the first interface 202. These locking elements can be a part of the protrusions (for example—a protrusion that has a tip that is wider than the base of the protrusion). The protrusions may end by round shaped tips.

The rotating element 212 can be connected to the brushing element axel 214 via a cylindrical bearing 213.

A rotation of the rotating element 212 about a brushing element axis 214 may force the first interface 202 and the front brushing element 211 to rotate, in coordination with the rotating element 212, about the brushing element axis 214.

There is also provided a rim 220' that prevents a track 310 (that matches the teeth of track receiving portion 220 by size and gauge) from detaching from the track receiving portion 220 and does not show a rim and an annular groove that are shaped to fit a rounded notch of the housing. The track receiving portion 220 may be followed by the annular groove and the rim. Similar track receiving portions and rims are illustrated in U.S. patent application 20090045110 of Garti which is incorporated herein by reference.

The track receiving portion 220 is connected to the rotating element 212 and causes the latter to rotate. The rotation of the track receiving portion 220 is induced by track 310 that is rotated in response to an activation of a drive motor of the cleaning robot.

According to another embodiment of the invention the rotation and reciprocal movements are obtained by having multiple brushing elements instead of a single one, allowing these brushing elements to move in relation to each other and one or more first interfaces that that have surfaces (that contact second interfaces) that not match each other such as to cause relative reciprocal movement of the brushing element in relation to each other. The different brushing elements (and additionally or alternatively the different first interfaces) can be connected to each other by elastic connectors such as springs.

Figure 4A:
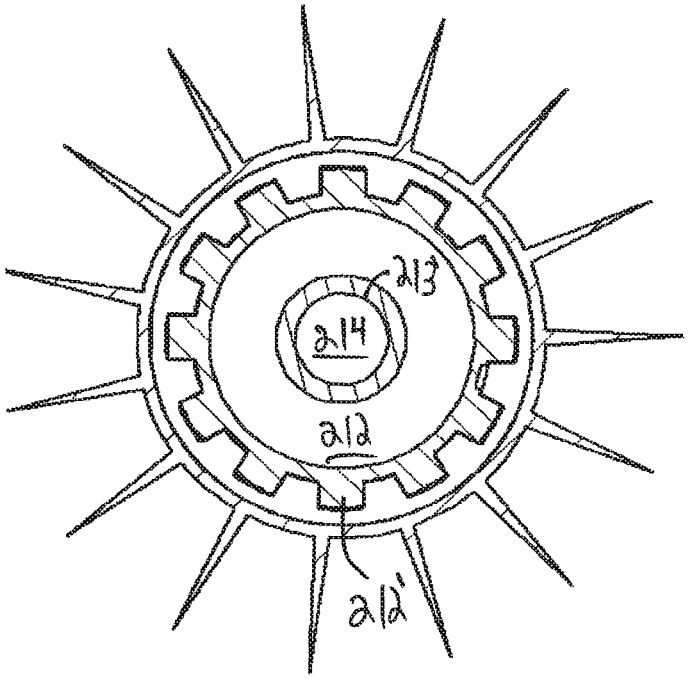
Figure 4B:
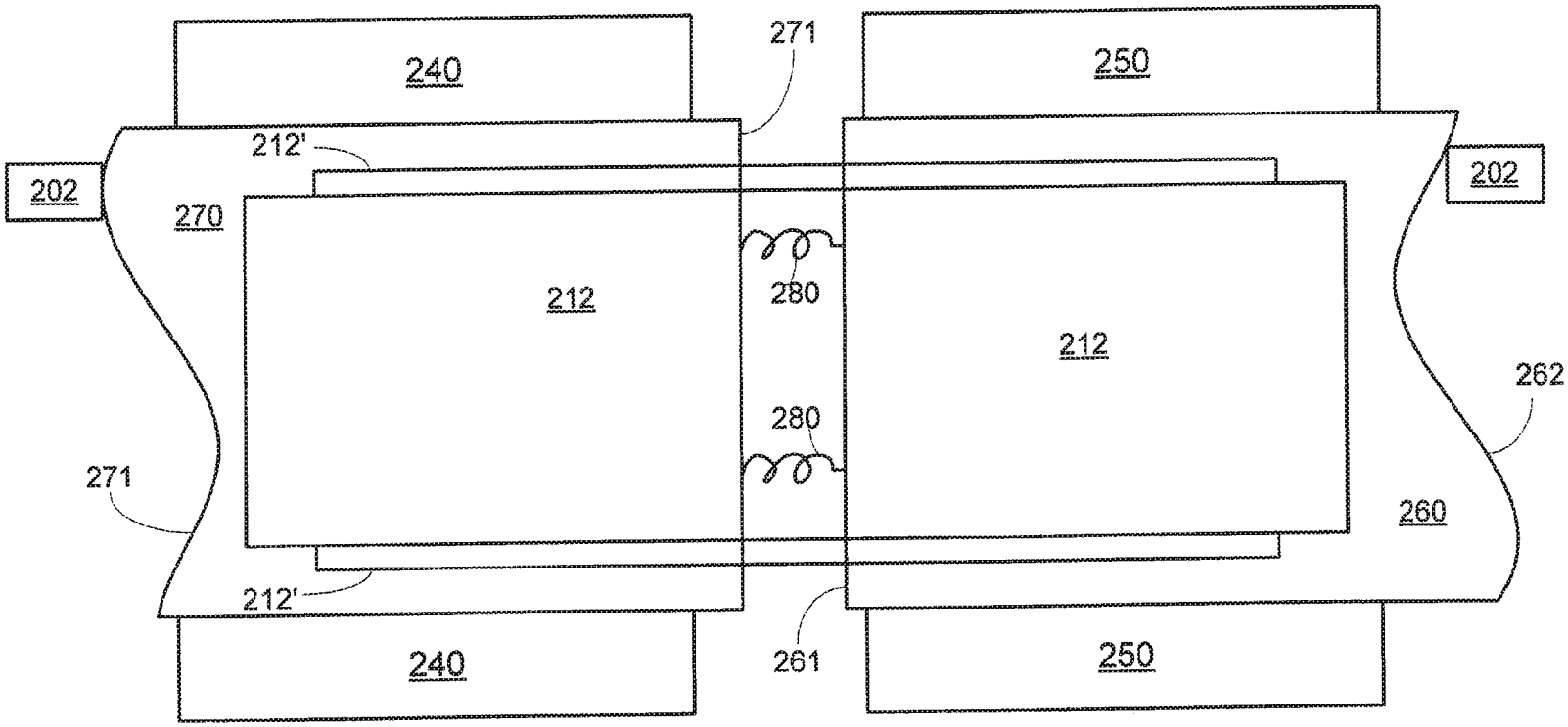
FIG. 4B is a cross sectional view of a front brushing unit and various interfaces according to an embodiment of the invention.

FIG. 4B is a horizontal cross sectional view of two brushing elements 240 and 250 and two interfacing elements 260 and 270 that share a rotating element 212 according to an embodiment of the invention.

Interfacing element 260 has an inner edge 261 that faces an inner edge 271 of interfacing element 270. Inner edges 261 and 271 may be connected to each other via elastic elements such as springs 280.

An outer edge 262 of interfacing element 260 may contact first interface 202 and an outer edge 272 of interfacing element 270 may contact another first interface 202.

The first interfaces 202 and each one of outer edges 262 and 272 do not match each other—in order to induce relative lateral movement between interfacing elements 260 and 270—and thus between brushing elements 240 and 250. For example, while outer edge 272 can have a sinusoidal cross section the outer edge 262 can have a planar cross section, a out of phase sinusoidal cross section, a ramped cross section and the like. Each of the brushing elements 240 and 250 is connected to a corresponding first interface out of first interfaces 260 and 270.

The interfacing elements 260 and 270 can be rotated by rotating element 212 while performing reciprocal movement in relation to rotating element 212. This can be achieved, for example, by using radially extending protrusions and matching curves in the rotating element 212 and each of the interfacing elements.

Change of Direction of Movement of the Cleaning Robot

According to an embodiment of the invention the cleaning robot can be tilted in order to change the direction of movement of the cleaning robot. The change of direction can be induced in various manners.

According to an embodiment of the invention there is provided a cleaning robot 10 that may include (referring to FIG. 1) a housing 13 and multiple movable elements such a rear right wheel 320, rear left wheel 322 and a front brushing unit 200 that extends throughout the entire front panel of the housing 13. The cleaning robot is also equipped with a right track 310 and a left track 312.

According to an embodiment of the invention when both tracks 310 and 312 contact the surface of the pool the cleaning robot 10 can move either forwards or backwards (depending upon the direction of rotation of tracks 310 and 312)—assuming that the movement of both tracks 310 and 312 are synchronized. Deviations from that direction of propagation can be achieved by jetting fluid from the cleaning robot 10 and especially by jetting fluid through openings of the multiple-opening cover portion 450.

If the different tracks do not contact the surface of the pool at the same manner (introduction of an imbalance between the tracks) and especially when one track contacts the surface while another does not contact the surface then the cleaning robot will turn towards the imbalance—towards the track that is in more contact with the surface. This imbalance can also be referred to as unevenness or asymmetry.

According to various embodiments of the invention the pool leaning robot 10 may include an imbalance induction unit that may be arranged to introduce an imbalance between at least two movable elements that results in a change in a direction of propagation of the cleaning robot 10. The imbalance induction unit may be arranged to induce the imbalance as a result of a movement of a nozzle for outputting fluid from the cleaning robot (illustrated in FIGS. 7-11), and, additionally or alternatively as a result of a movement of a diaphragm that is loosely connected to the housing (FIGS. 5 and 6).

Figure 5:
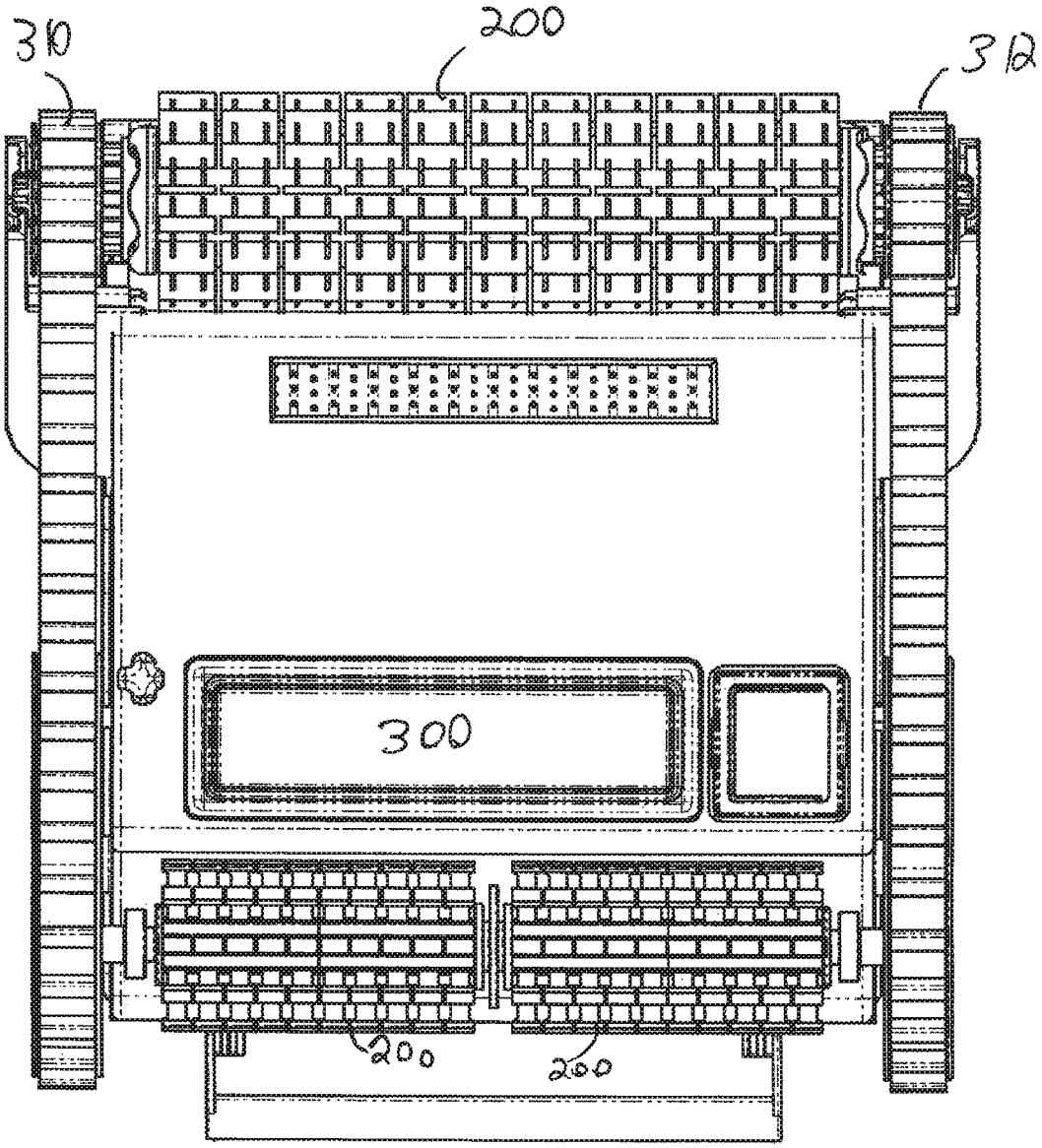
FIG. 5 illustrates a cleaning robot according to an embodiment of the invention.
Figure 6:
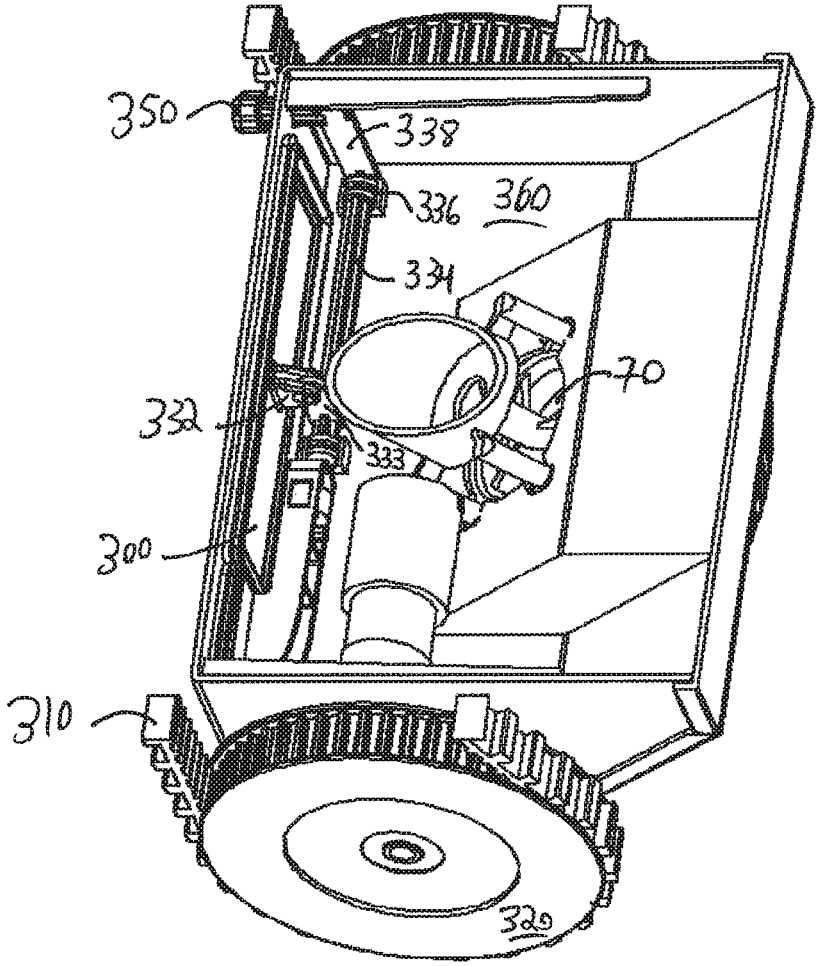
FIGS. 6-12 are cross sectional views illustrating various portions of cleaning robots according to various embodiments of the invention.

FIGS. 5 and 6 illustrates a cleaning robot 10 in which the imbalance induction unit may be arranged to induce the imbalance as a result of the movement of a diaphragm 300 that is loosely connected to the housing 13. The diaphragm 300, when positioned in a low position (FIGS. 5 and 6) fits into an aperture 302 defined in the bottom panel 16 of the housing 13.

A change in the position of the diaphragm 300 may be responsive to a change in a status of an impeller 70 of the cleaning robot. When the impeller 70 draws fluid through input nozzle 410 (and through aperture 302) the diaphragm 300 is drawn upwards—towards the impeller 70.

The diaphragm transmission 330 may be arranged to convert a change in a location of the diaphragm 300 to a change in an elevation of the protrusion 350 that once located at a low position contacts the surface of the pool and induces the imbalance between the at least two movable elements.

The protrusion 350 may be illustrated as being distant from a longitudinal axis of symmetry of the cleaning robot 10. It should not be located along the longitudinal axis in order to induce an imbalance between tracks 312 and 310. Alternatively, the protrusion 350 can be located at the longitudinal axis but will have an asymmetrical tip (such as a sloped tip) that contacts the surface of the pool such as to introduce the imbalance.

FIG. 6 illustrates the diaphragm transmission 330 as connected to the diaphragm 300 via handle 332 that vertically extends from the diaphragm 300 and (a) forces the diaphragm 300 to perform a rotational movement, and (b) translates the rotational movement to a linear movement so that protrusion 350 moves downwards (when the diaphragm 300 movers towards the impeller 71 and thereby tilts the cleaning robot towards the right (and even detaching left track 312 from the surface of the pool). It is noted that the diaphragm can follow other paths than the curved path forced by the diaphragm transmission 330 of FIG. 5.

After the impeller 71 stops drawing the fluid, the diaphragm 300 returns to its low diaphragm position and may seal the aperture 302.

FIG. 6 illustrates an example of a diaphragm transmission 330. It includes a diaphragm axle 334 that is horizontal and is rotatably connected to a vertical inner wall 360 of the cleaning robot 10 via curved clips 336 that allow the diaphragm axle 334 to rotate about an axis.

The diaphragm axle 334 is connected to two radially extending elements—a first radially extending element 333 that is rotatably connected to handle 332 and a second radially extending element 338 that is rotatably connected to protrusion 350 such as to translate the rotational movement of the diaphragm axle 334 to (a) a curved movement of the diaphragm 300 and to (b) a linear movement of the protrusion 350 (the movement of the latter is further confined to linear movement by an aperture in the bottom panel 16 through which the protrusion 350 moves.

FIGS. 7-11 illustrate an imbalance induction unit that may be arranged to induce an imbalance between moving components of the cleaning robot as a result of a movement of a nozzle for outputting fluid from the cleaning robot 10.

The nozzle 410 can be moved along a predefined path and the movement of the nozzle 410 can be translated (by a nozzle transmission) to a linear movement of a protrusion that can tilt the cleaning robot and induce the imbalance.

FIGS. 7-11 illustrate a conversion of a rotary movement of the nozzle 410 to a linear movement of the protrusion 350. It is noted that there can be provided other types of movements (of either one of the nozzle and the protrusion) without departing from the scope of the invention. For example the protrusion can have a radially a-symmetrical cross section and can be rotated in order to introduce the imbalance. For example an X shaped cross section protrusion can be rotated in order to introduce the imbalance, an elliptical cross section protrusion can be rotated in order to induce the imbalance and the like. Yet for another example the nozzle can be moved along a linear path.

The protrusion 350 may be illustrated as being distant from a longitudinal axis of symmetry of the cleaning robot 10. It should not be located along the longitudinal axis in order to induce an imbalance between tracks 312 and 310. Alternatively, the protrusion 350 can be located at the longitudinal axis but will have an asymmetrical tip (such as a sloped tip) that contacts the surface of the pool such as to introduce the imbalance.

Figure 7:
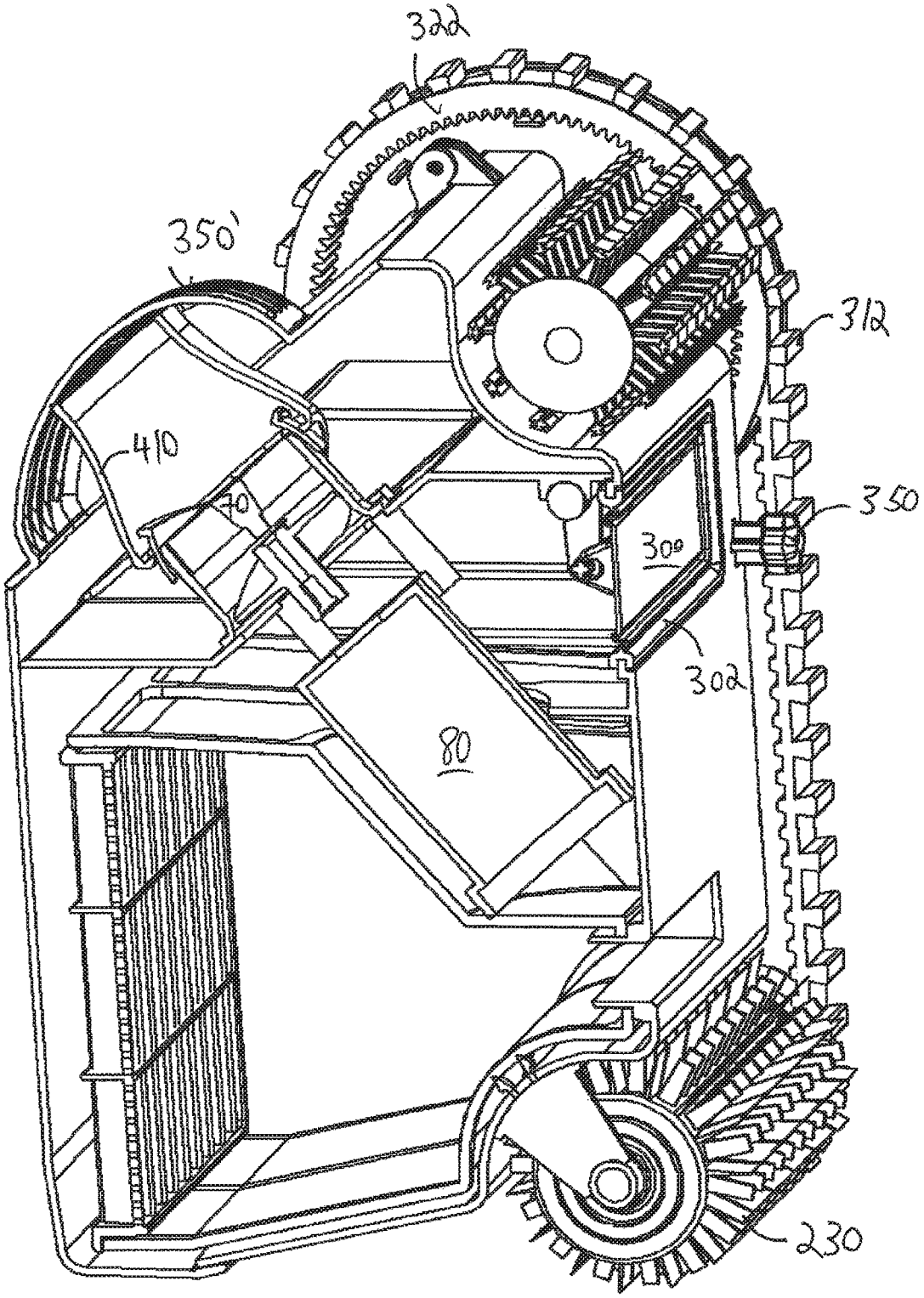
Figure 21A:
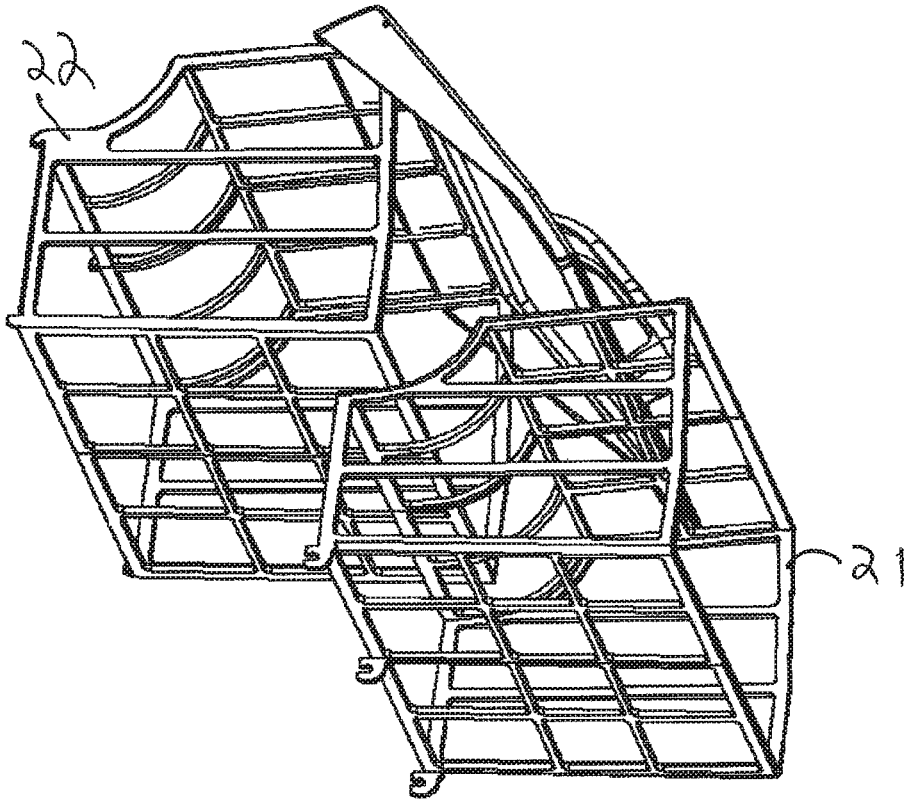
FIGS. 21A and 21B illustrate a filtering unit according to an embodiment of the invention.
Figure 21B:
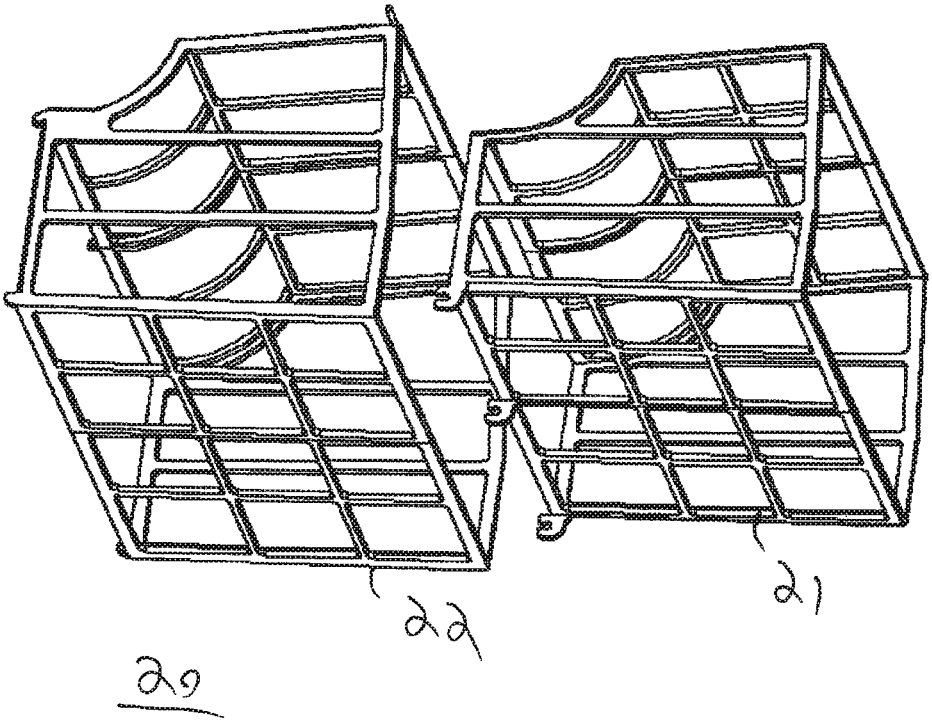

FIG. 7 is a cross sectional view of the cleaning robot 10 that illustrates various internal components of the cleaning robot—such as filtering unit 20. FIGS. 21A and 21B illustrate the filtering unit 20 according to various embodiments of the invention.

The filtering unit 20 may include one or more filters of one or more filtering levels (a filter level defines the size of particles that may pass through the filter) such as a gross filter and a fine filter.

It is noted that the filtering unit 20 can include three or more filters. It may have at least one additional filter.

Any additional filter may have a filtering level that differs from the first and second filtering levels or equals one of the first and second filtering levels.

The cleaning robot can have a handle that is coupled to the filtering unit and extends outside an opening formed in the housing.

The handle can be connected to the filtering unit and extend outside an opening formed in the housing.

The fluid can enter the filtering unit 20 through an opening 380 that is formed in the bottom plate 16 of the housing this opening 380 allows fluid to enter an inner space surrounded by a first filter 21, to be filtered by the first filter 21 to provide a firstly filtered fluid that propagates towards the second filter 22 to be further filtered by the second filter to provide secondary filtered fluid (Also referred to as filtered fluid). According to an embodiment of the invention the second filter 22 may partially surround the first filter 21.

The first filtering level may exceeds the second filtering level—as the first filter 21 is arranged to perform a coarser filtering than the second filter 22.

FIG. 7 illustrates the pump motor 80 that drives the impeller 70 as being oriented at about forty five degrees to the bottom panel 16 but other orientations can be provided.

The nozzle 410 can rotate about a nozzle axis that is parallel to a traverse axis of the cleaning robot 10, wherein the rotation can occur within a central plane that includes the longitudinal axis of the cleaning robot 10.

Figure 8:
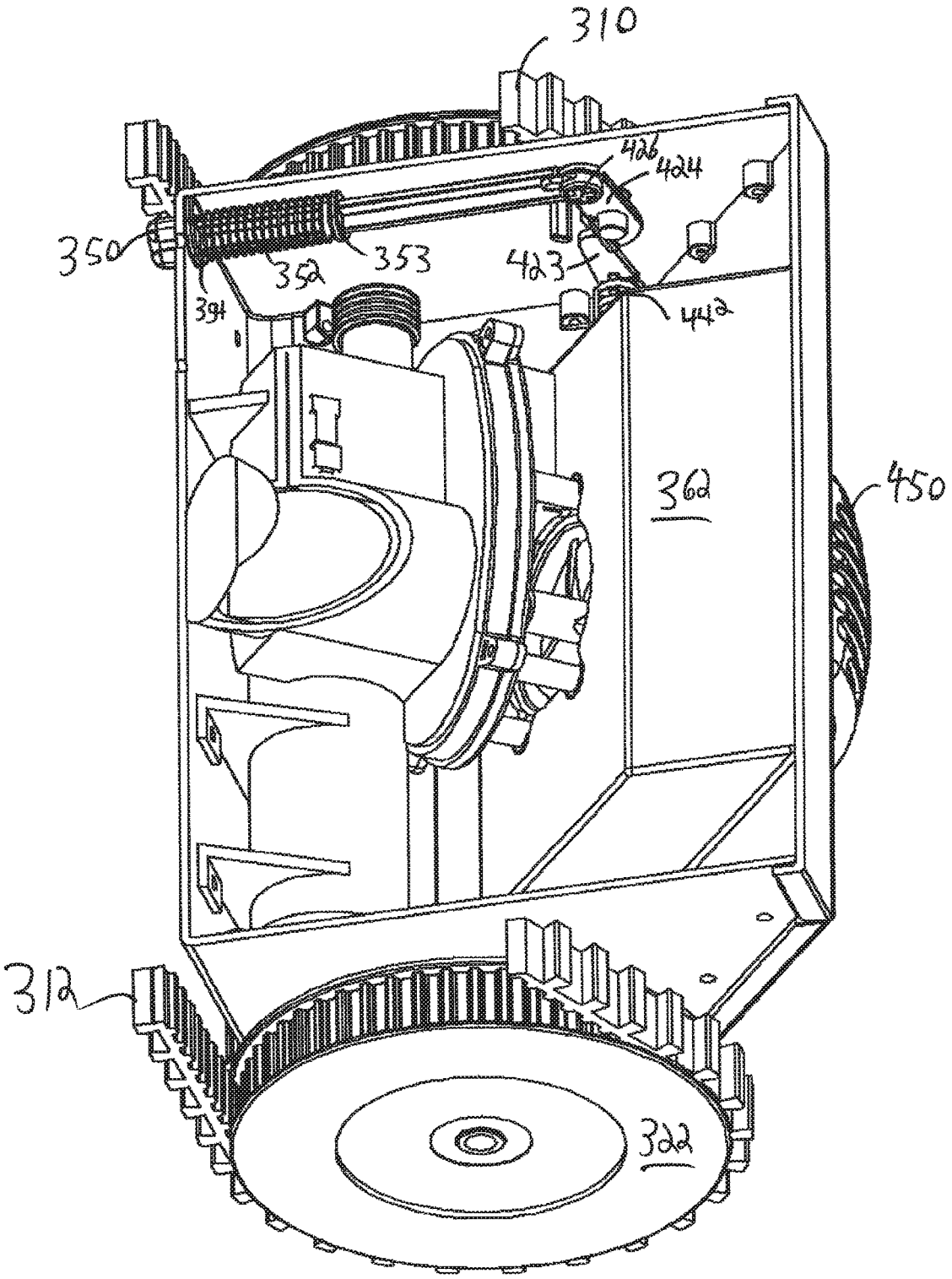
Figure 9:
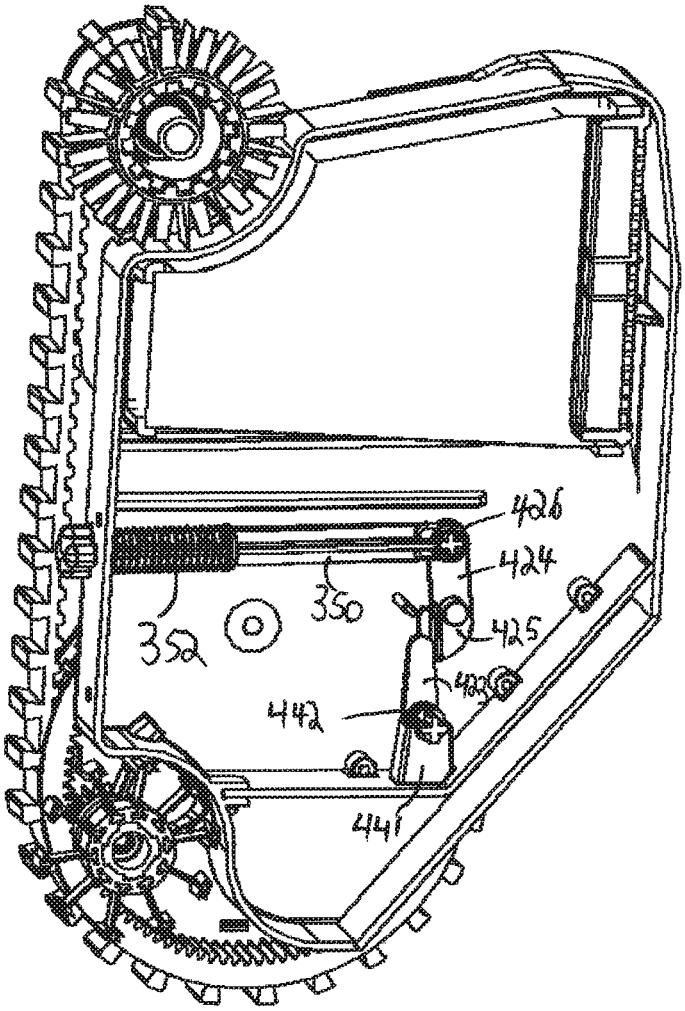
Figure 10:
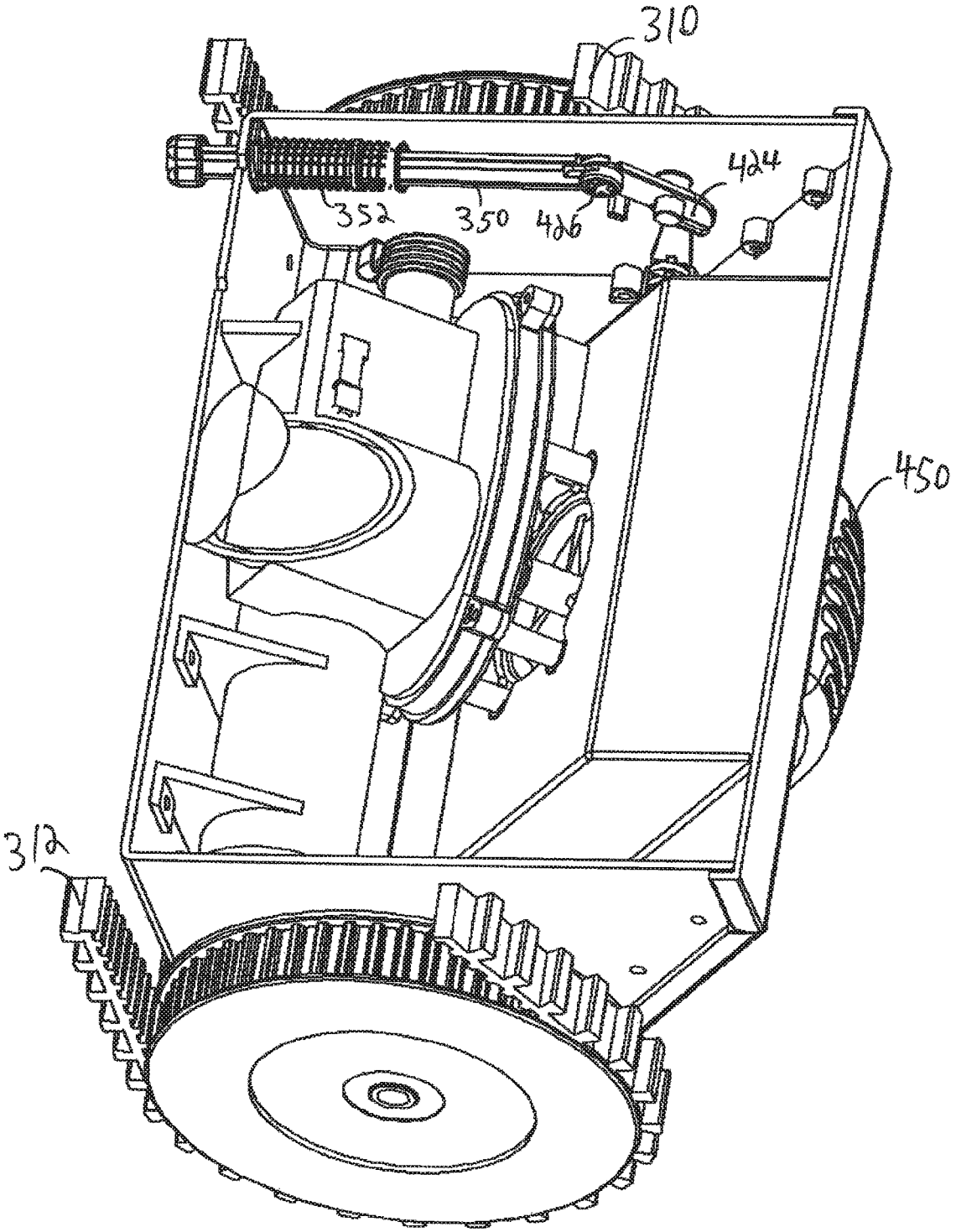
Figure 11:
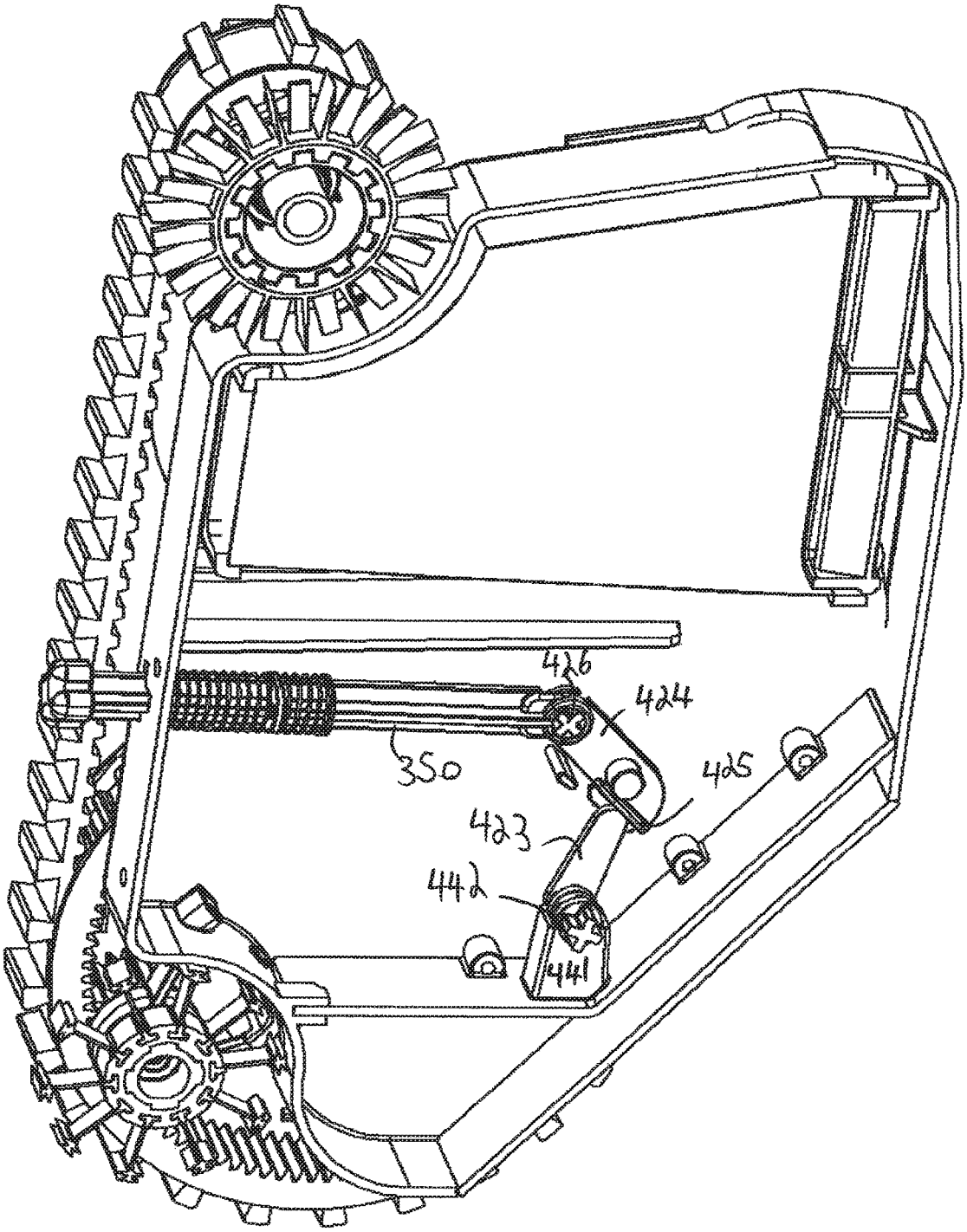

FIGS. 8-10 illustrate a spring 352 that is positioned between (a) disk 353 that is connected to protrusion 350 and (b) upper disk 354 that surrounds the opening through which protrusions 350 moves.

The spring 352 induces the protrusion 350 to be elevated to a higher protrusion position in which the lower end of protrusion 350 does not contact the surface of the pool—and does not introduce an imbalance between tracks 310 and 312.

The protrusion 350 may be moved downwards to a lower protrusion position and to induce the imbalance between the tracks by nozzle transmission 420 that converts a counter-clockwise movement of the nozzle 410 to a downwards movement of the protrusion 350.

The nozzle transmission 420 includes: nozzle axle 442 that is connected to a vertical bevel gear 502 (used to rotate the nozzle 410) and is rotatably connected to second vertical inner wall 362 of the cleaning robot 10 via curved clip 441 that allows the nozzle axle 442 to rotate about an axis. The nozzle axle 442 is connected to a radially extending element 423 that interfaces with a first fin 425 that is fixed to a second fin 424. The second fin 424 is rotatably connected to sidewall of housing 13 and is parallel to the sidewall while first fin 425 is normal to that sidewall. A clockwise rotational movement of the nozzle axle 442 elevates radially extending element 423 that in turn elevates first fin 425 and causes the second fin to rotate counterclockwise and thereby lower projection 350 that is rotatably connected to the second fin 424 (via cylindrical interfacing element 426).

Multiple Directional Fluid Jetting Arrangement

According to an embodiment of the invention fluid can be jetted from the cleaning robot in multiple different directions, wherein the directions are determined by a rotational movement of the nozzle and by the state of the impeller 70—static, rotational movement along a first direction and rotational movement along a second rotational direction.

Referring to FIGS. 1 and 12-15 the cleaning robot 10 is illustrated as including a housing 13 that includes a multiple-opening cover portion 450. The multiple-opening cover portion 450 is positioned at a center of a rear panel 14 of the housing 13 and includes a right opening 452, a left opening 454 and a central opening 456 that includes an array of narrow and elongated openings that have a curved cross section.

The right opening 452 faces the right of the cleaning robot 10.

The left opening 454 faces the left of the cleaning robot 10 and both openings (452 and 454) can be parallel to the left or right sidewalls of the housing 13.

The multiple-opening cover portion 450 is positioned at the center of the cleaning robot 10 and its right and left openings 452 and 454 are positioned in a symmetrical manner in relation to the longitudinal axis 701 of the cleaning robot 10. They have the same shape (rectangular) and size but may differ from each other by shape size, and location.

The right opening 452 is preceded by a right fluid conduit 462 that is substantially horizontal. The right fluid conduit 462 may be arranged to direct fluid from the nozzle 410 to the right of the housing (through the right opening 452).

The left opening 454 is preceded by a left fluid conduit 464 that is substantially horizontal. The left fluid conduit 464 may be arranged to direct fluid from the nozzle 410 to the left of the housing (through the left opening 454).

Figure 12:
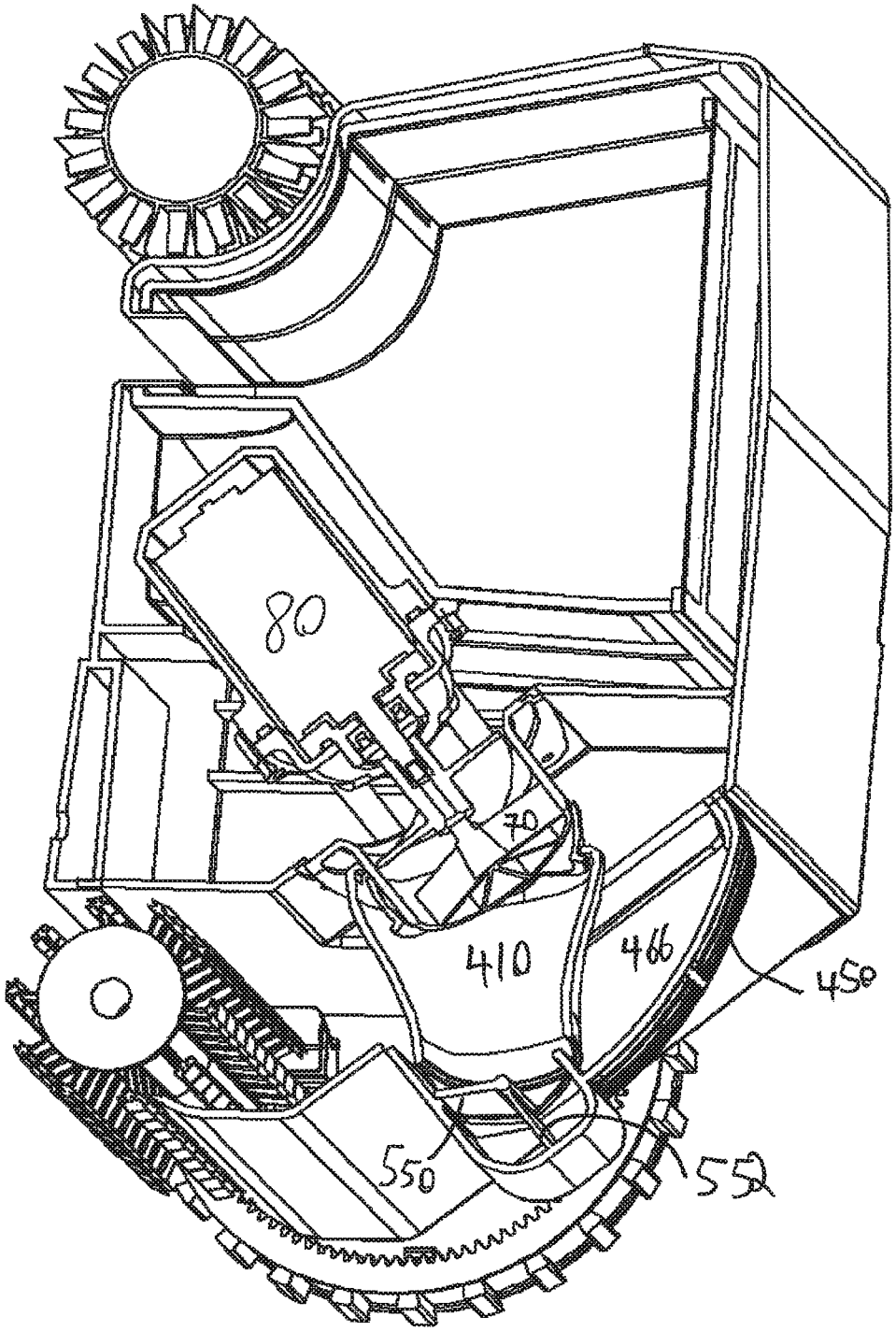
Figure 13:
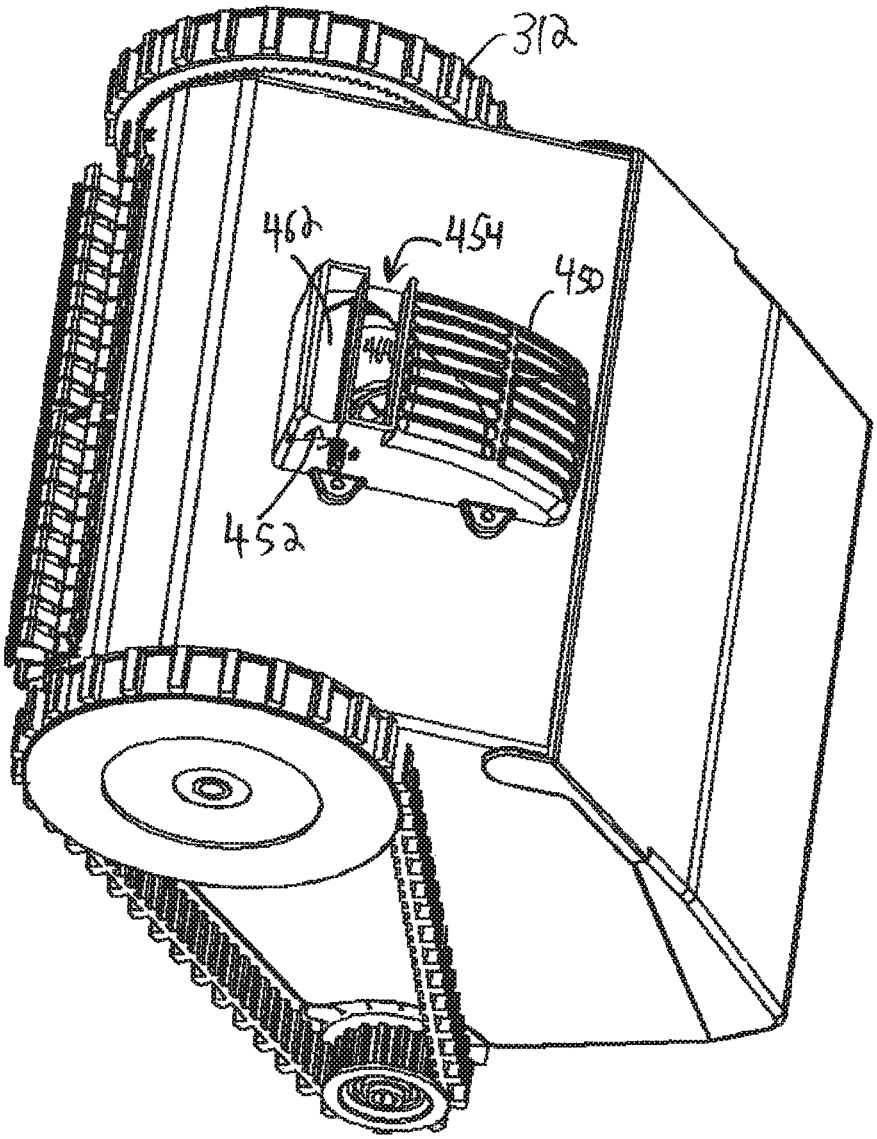
FIG. 13 illustrates a rear panel of a cleaning robot according to an embodiment of the invention.
Figure 14:
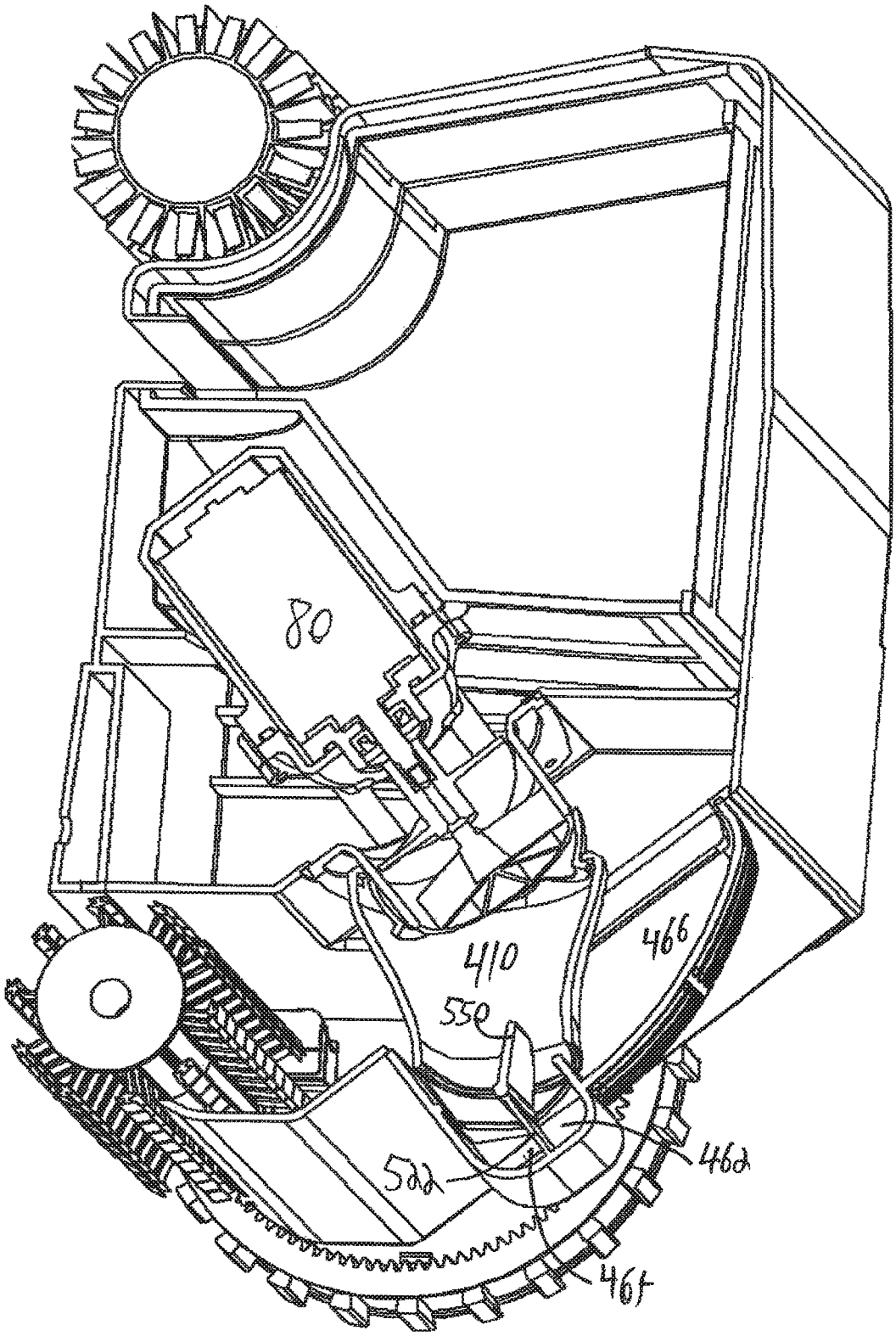
FIGS. 14, 15 and 18 are cross sectional views illustrating various portions of cleaning robots according to various embodiments of the invention.
Figure 15:
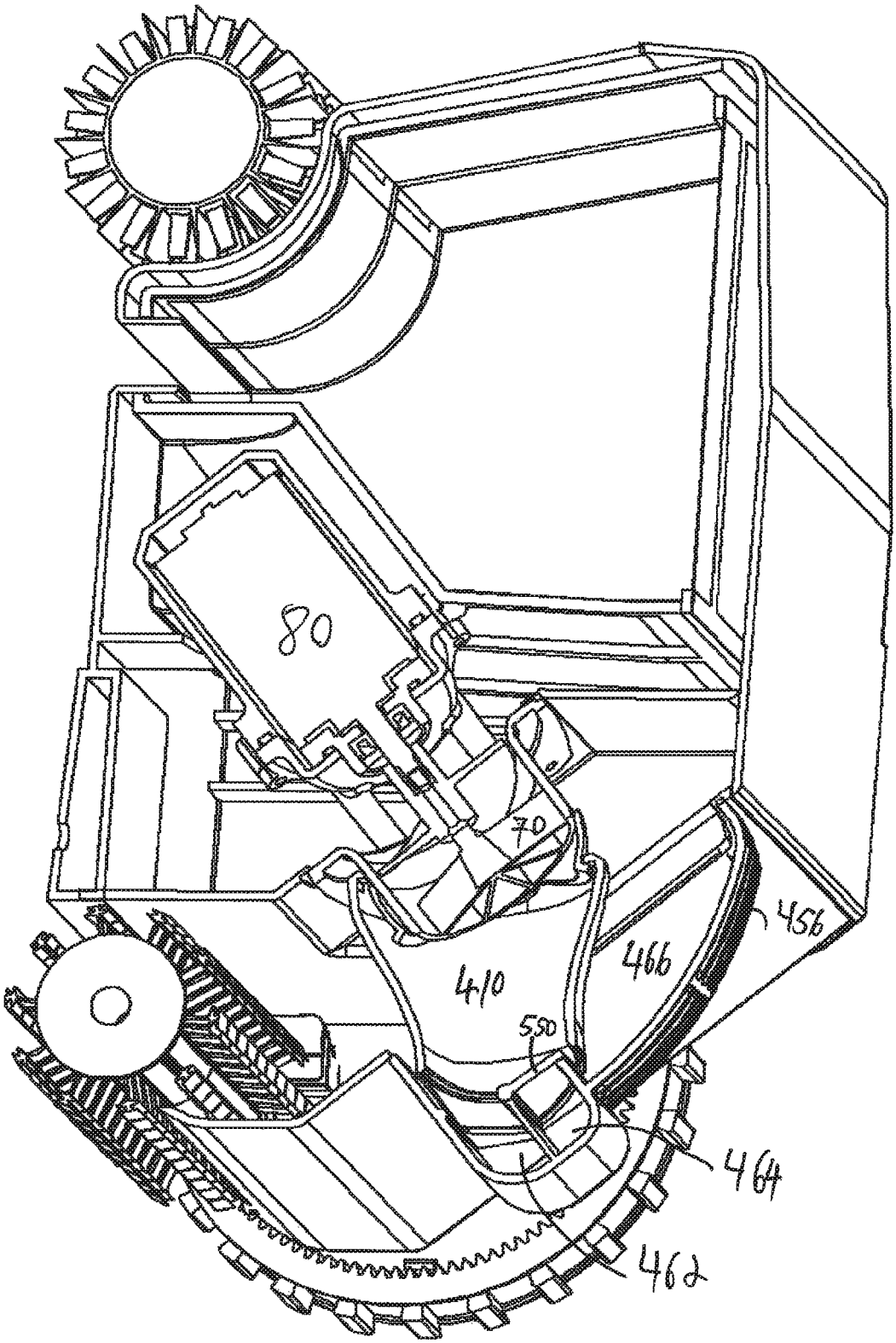

FIGS. 12, 14 and 15 illustrate the right and left fluid conduits 462 and 464 as sharing a sidewall.

The central opening 456 is preceded by a central conduit 466 that faces the nozzle 410.

The nozzle 410 can be rotated and thus follow a curved path that changes its orientation, for example from being vertical to being horizontal. Other ranges of orientations can be obtained.

Figure 16:
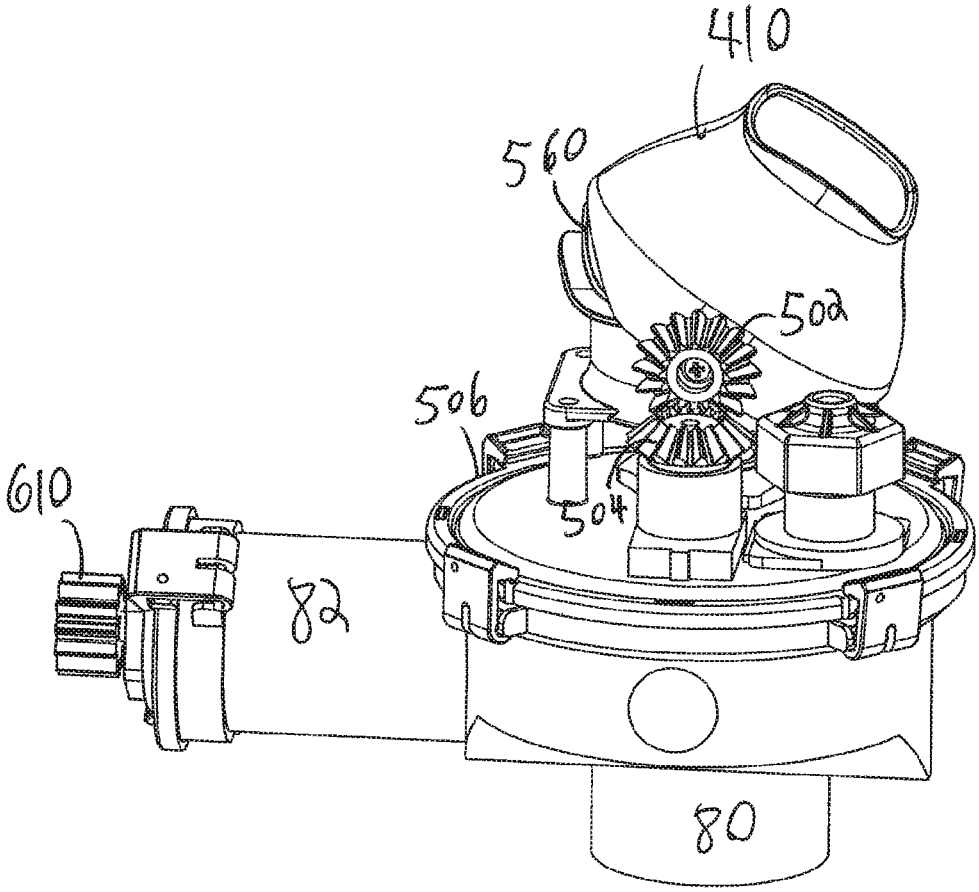
FIG. 16 illustrates a nozzle, a pump motor, and drive motor and a nozzle transmission according to a further embodiment of the invention.

FIG. 16 illustrates the nozzle 410, a pump motor 80, a drive motor 82, a removable cover 506 of a sealed housing (not shown) that encloses the drive motor 82 and the pump motor 80), a horizontal bevel gear 504 that mashes with a vertical bevel gear 502, the horizontal bevel gear 504 rotates about an vertical axis by a motor (not shown) and this rotation is translated by the pair of horizontal and vertical bevel gears 504 and 506 to a vertical rotation of the nozzle 410 that changes the orientation of the nozzle.

The nozzle 410 can be rotatably connected to a support element (not shown) that may support the nozzle 410 and facilitate the rotational movement of the nozzle 410. The nozzle 410 can interface with a curved cover 560 that prevents fluid from exiting a path defined by the nozzle 410 and any of the conduits (462, 464 and 466) during the entire rotational movement of the nozzle 410.

The horizontal and vertical bevel gears 502 and 504 and the motor that drives the horizontal bevel gear 502 may form a nozzle manipulator that may be arranged to rotate the nozzle 410 about a nozzle axis such as to alter an orientation of the nozzle 410 in relation to the longitudinal axis 701.

The right, left and central conduits 462, 464 and 466 may belong to a fluid interfacing unit that may be arranged to direct fluid from the nozzle 410 (a) towards the central fluid conduit 466 when the nozzle 410 is at a first orientation, (b) towards the right fluid conduit 462 when the nozzle 410 is at a second orientation, and (c) towards the left fluid conduit 464 when the nozzle 410 is at a third orientation. The first orientation differs from the second and third orientations.

The second orientation may substantially differ from the third orientation—but this is not illustrated in FIGS. 12, 14 and 15.

These figures (FIGS. 12, 14 and 15) illustrate an embodiment in which the second orientation substantially equals the third orientation (for example—a forty five degree orientation) and wherein a selection between the left fluid conduit 464 and the right fluid conduit 462 may be made by rotating the nozzle 410 and, additionally or alternatively, by changing an operational mode of the impeller 70—static, rotation at a first rotational direction or rotation at a second rotational direction.

FIGS. 12, 14 and 15 illustrate a shutter 550 that is pivotally connected to a shared sidewall 552 of the left and right fluid conduits 462 and 464. The shutter 550 is pivotally connected to the shared sidewall 552 via a spring (not shown) that tends to force the shutter 550 towards an initial shutter position in which the shutter 550 is slightly oriented towards an opening 464' formed in the left fluid conduit 464.

The nozzle 410 can be moved from a first or fourth orientation to a second orientation while the impeller 70 pushes fluid to exit the nozzle 410 during this movement so that the flow of fluid will cause the shutter 550 to complete an upward (clockwise) movement (and be out of the reach of the nozzle 410) and to shut the opening 464' formed in the left fluid conduit 464 so that the fluid can enter opening 462' formed in the right fluid conduit 462 and exit through the right opening 452.

If the same movement of the nozzle 410 is done without pushing fluid towards the shutter 550 then the nozzle 410 can move the shutter 550 downwards to close the opening of the 462' formed in the right fluid conduit 462 so that the fluid can enter opening 464' formed in the left fluid conduit 464 and to exit through the left opening 454.

The nozzle manipulator unit may be arranged to position the nozzle 410 at a fourth orientation that may also face the center opening 466.

Figure 17:
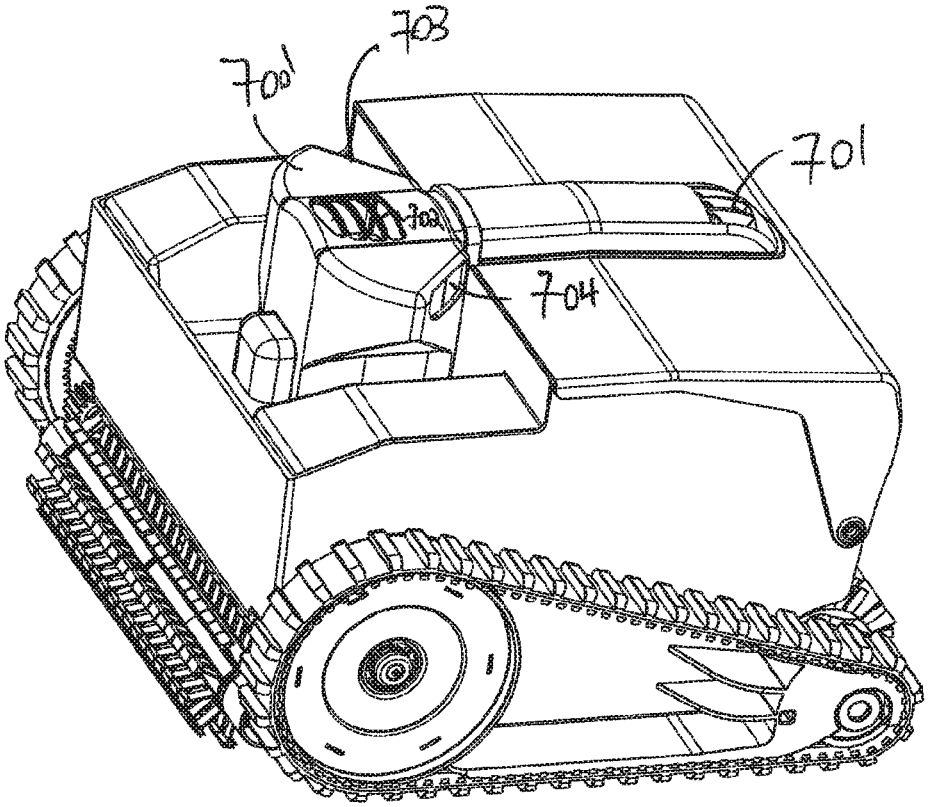
FIG. 17 illustrates a cleaning robot according to an embodiment of the invention.

FIG. 17 illustrates a robot 11 according to an embodiment of the invention. The robot 10 has a multiple opening structure 720 that has a right aperture 724, a left aperture 723, a upper aperture 722 and a rear aperture 721 that face the right, left, upper and rear directions and are preceded by fluid conduits that facilitate a flow of fluid from an inner space in which the nozzle is allowed to move such as to face one or more of these fluid conduits and allow the fluid to exit via one of the apertures and assist in directing the robot to move along a desired direction. The nozzle can perform a movement along to degrees of freedom so that it can face the different openings.

Asymmetrical Position of Components

Figure 18:
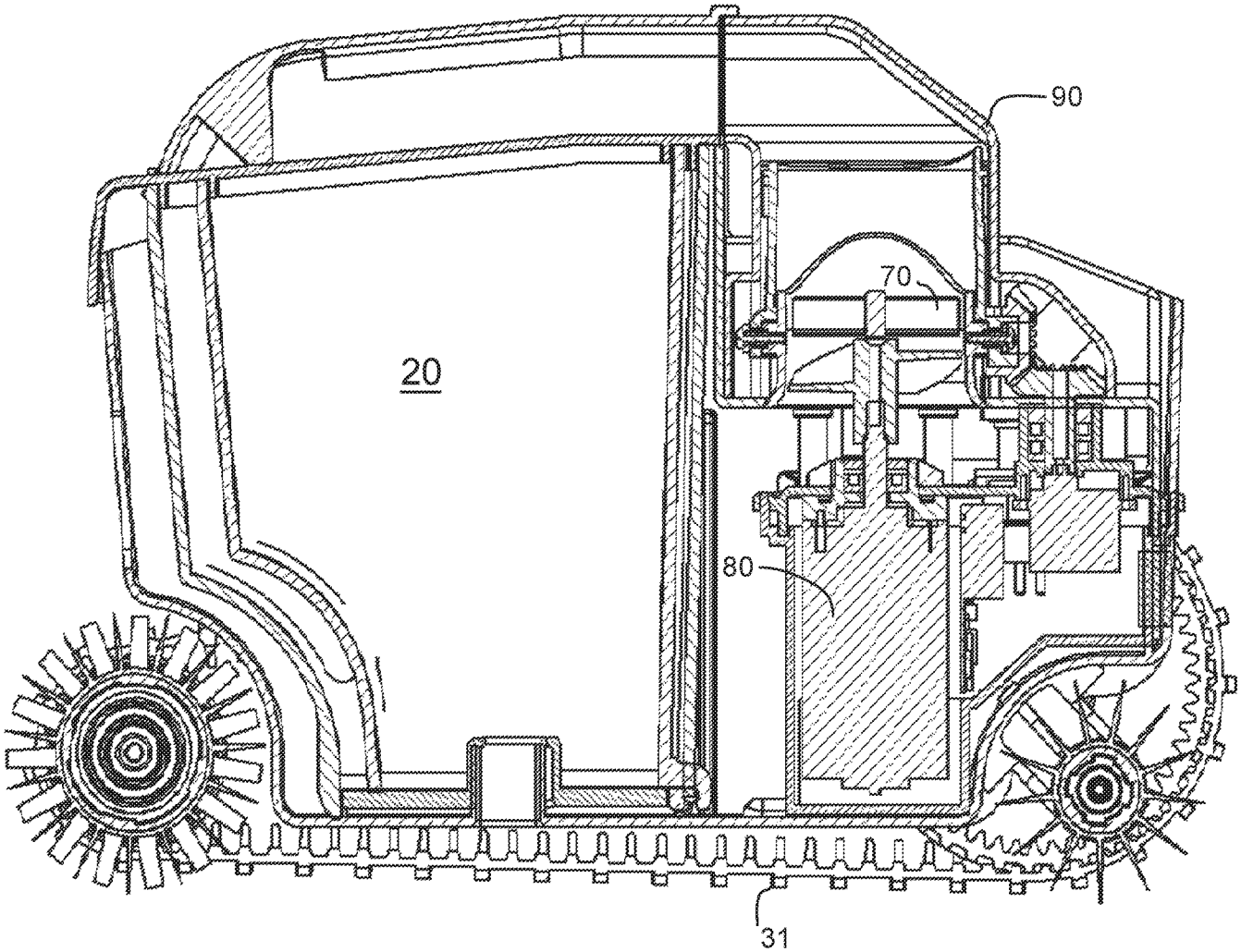

FIG. 18 illustrates a cleaning robot that includes a drive motor 610 that is arranged to rotate multiple rotating elements such as any of the wheels and tracks mentioned in any of the previous figures), at least some of which are arranged to contact a surface of the pool, an impeller 70, a pump motor 80 that is arranged to rotate the impeller 70; a housing 13 that encloses a drive motor (not shown), the pump motor 80 and the impeller 70; a filtering unit 20; and front and rear brushing units 200 and 200'.

The pump motor 80, the drive motor and the impeller 70 are substantially closer to a front edge 601 of the housing than to a rear edge 604 of the housing. Their center of gravity is located between a traverse axis 701 and the front edge 601.

The proximity of these components to the front edge (and the placing of these components outside the center 630 of the housing) may assist in reducing the aggregation of air bubbles in the cleaning robot—as bubbles that enter the pool cleaning robot via apertures located at the housing are not forced to pass through the filtering unit 20 (positioned near the rear edge of the housing) and are also (if entering the front edge that may surface above the fluid of the pool) may be quickly ejected by the impeller that is also located near the front edge.

A distance of each one of the pump motor, drive motor and the impeller from the front edge of the housing is at least 10%, 15%, 20%, 25%, 30% smaller than a corresponding distance to the rear edge of the housing.

Optical Sensor and Compass

Figure 19:
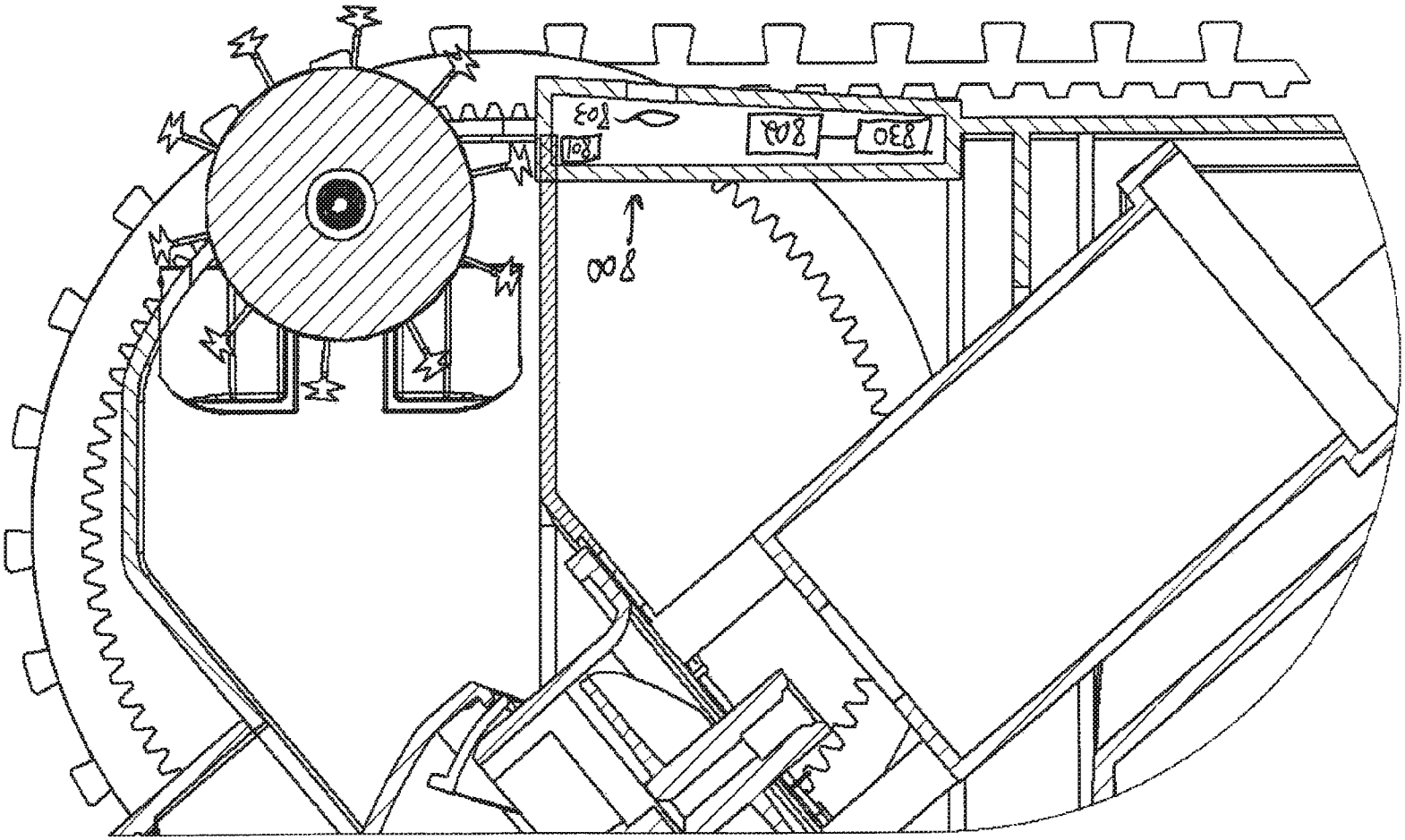
FIG. 19 illustrates a portion of a cleaning robot according to an embodiment of the invention.

According to various embodiments of the invention the robot can have an optical sensor 800 that may be arranged to detect motion. The detection signals of the optical sensor can be processed by a controller that may in turn control the movement of the robot according to a desired path and motion detection. The optical sensor 800 can be located at the bottom of the robot or in any other location. FIG. 19 illustrates a robot that is equipped with an optical sensor 800 that is positioned at the center of the robot (along its longitudinal axis) and at the bottom panel of the robot. It is noted that the optical sensor 800 can be located elsewhere. The optical sensor 800 can include a radiation source 801, a detector 802, optics 803 and a detection signal processor 804. The detector 802 and the detection signal processor 804 can be equivalent to those that are being used in a computer mouse.

The radiation source 801 can include one or multiple light sources such as an array of light emitting diodes. The radiation source 801 can generate radiation at various wavelengths—such as between 630 to 618 nm. The optics 803 may include an objective lens that is expected to focus reflected radiation from the surface of the pool onto the detector 802, while the detector is more distant (for example—20 mm) from the surface of the pool in comparison to the distance (about 6 mm) from the detector of a computer mouse to a surface. The depth of view of the objective lens should be about 4 mm and the radiation can be impinging on the surface at an angle of about 45 degrees.

Additionally or alternatively, the robot may include a pair of compasses that may provide directional information that may be processed in order to determine the location of the robot.

Figure 20:
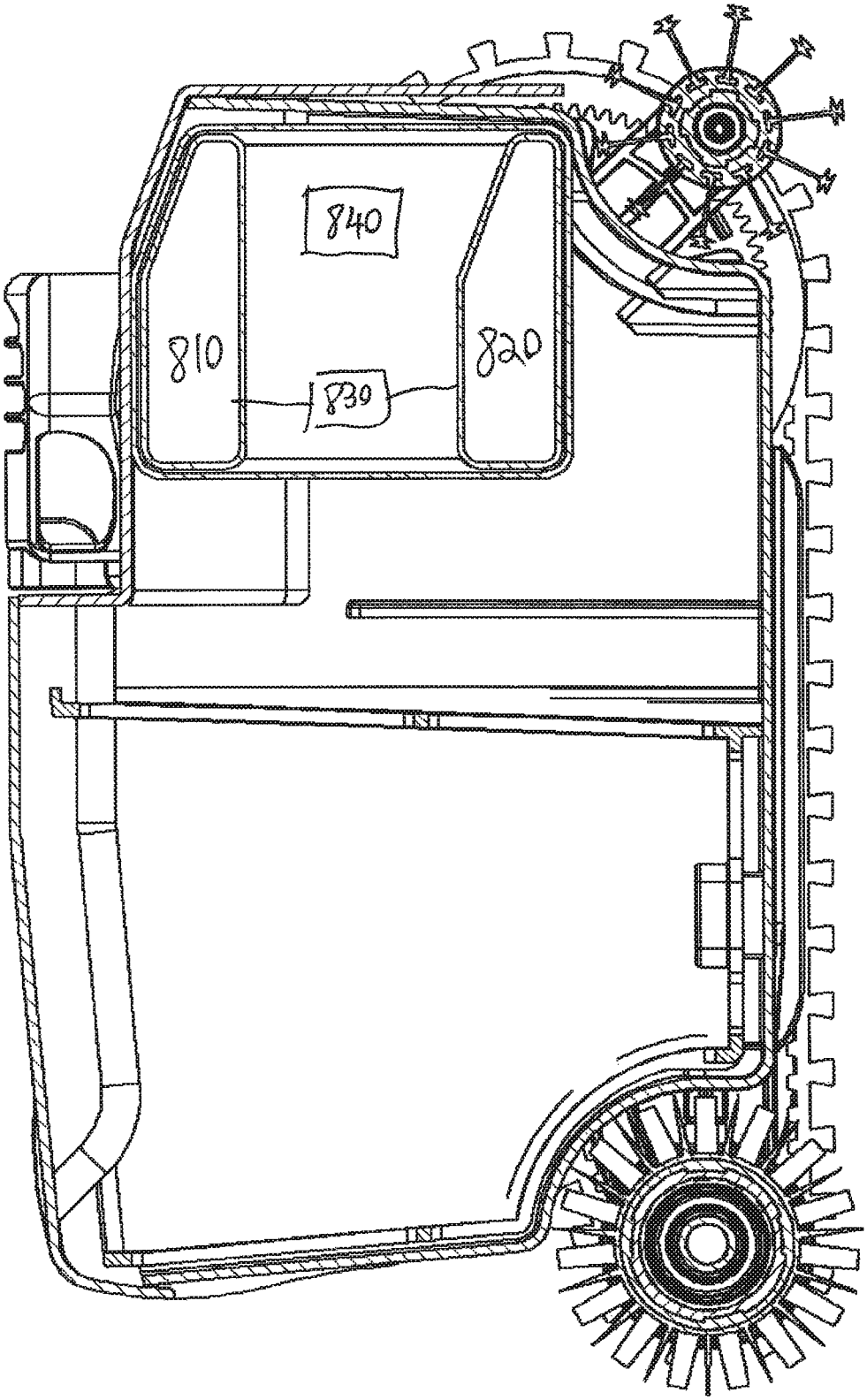
FIG. 20 illustrates a cleaning robot according to an embodiment of the invention.

FIG. 20 illustrates a robot that is equipped with a first compass 810 and a second compass 820.

The first and second compasses 810 and 820 are either positioned or configured so that they are expected to react in a different manner to magnetic field interferences that result from metal elements such as metal infrastructure that belongs to the pool, supports the pool or otherwise is proximate to the pool. The first and second compasses 810 and 820 can be positioned in different locations—for example the first compass 810 can be positioned above the second compass 820 so that the first compass will be more sensitive to magnetic interferences resulting, from example, from the bottom of the pool. Yet according to an embodiment of the invention one of the compasses can be magnetically shielded in a different manner than the other compass.

It is expected that at the absence of magnetic interferences both compasses will provide substantially the same directional information. Usually small deviations between the directional information provided by different compasses are allowed.

A threshold can be defined and it should exceed the small deviation by a safety margin.

If the differences between first directional information provided by the first compass 810 and second directional information provided by the second compass 820 exceeds the threshold it may be concluded that at least one of the compasses is magnetically interfered. In this case at least one or both of the first or second directional information can be ignored of or given lower weight.

It is noted that the processor 830 can compare between the first and second directional information by applying multiple thresholds or by applying non-threshold based comparisons.

The first compass 810 and the second compass 820 provide their directional information to a processor 830 that is arranged to receive directional information from the first and second compasses and to determine a direction parameter of the cleaning robot based upon the first and second directional information.

The processor 830 may be arranged to compare the first and second directional information to provide a comparison result; and to determine a validity of at least one of the first and second directional information based upon the comparison result.

The processor 830 may be arranged to declare the first directional information as invalid if a difference between the first and second results exceeds the threshold.

The processor 830 may be arranged to declare the first directional information and the second directional information as invalid if a difference between the first and second results exceeds a threshold.

FIG. 20 illustrates the first compass 810 as being positioned above the second compass 820.

According to an embodiment of the invention the cleaning robot can also include a non-magnetic sensor arranged to generate output signals indicative of a location of the cleaning robot. The non-magnetic sensor can be a counter that counts rotations of a wheel of the cleaning robot, a gyroscope, an accelerometer, an optical sensor or any other non-magnetic sensor that can obtain information without relying on magnetic fields and that may output location information or information that can be processed to obtain the location of the cleaning robot.

FIG. 20 also illustrates the non-magnetic sensor 840. It is coupled to the processor 830.

The processor 830 may be arranged to assign more weight to output signals of the non-magnetic sensor 840 than to the first and second directional information if it is determined that a difference between the first and second results exceeds a threshold.

The robot can have both compass 810 and 820 as well as optical sensor 800 or only one of these components.

Figure 22:
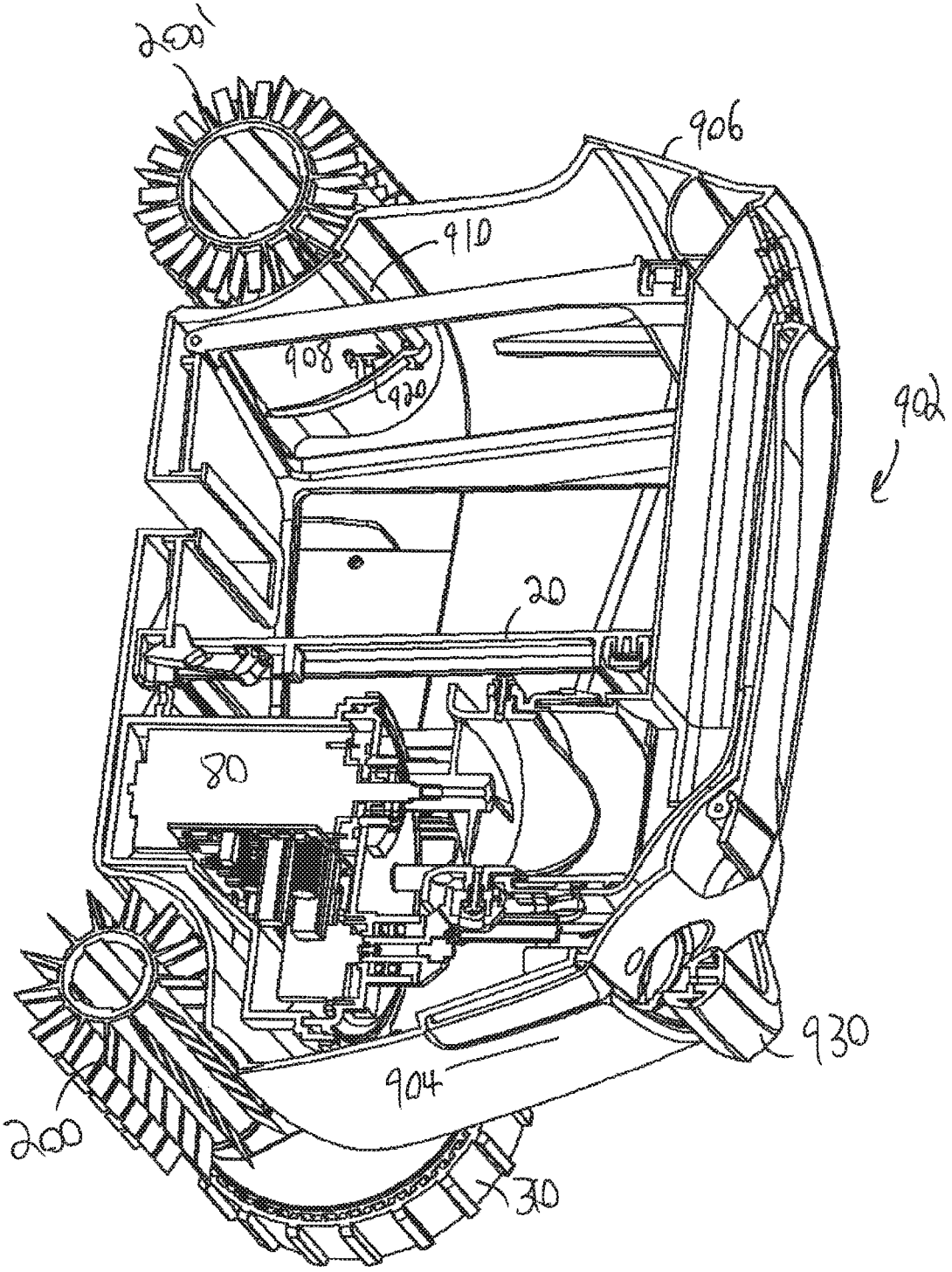
FIGS. 22-24 illustrate a cleaning robot according to various embodiments of the invention.
Figure 23:
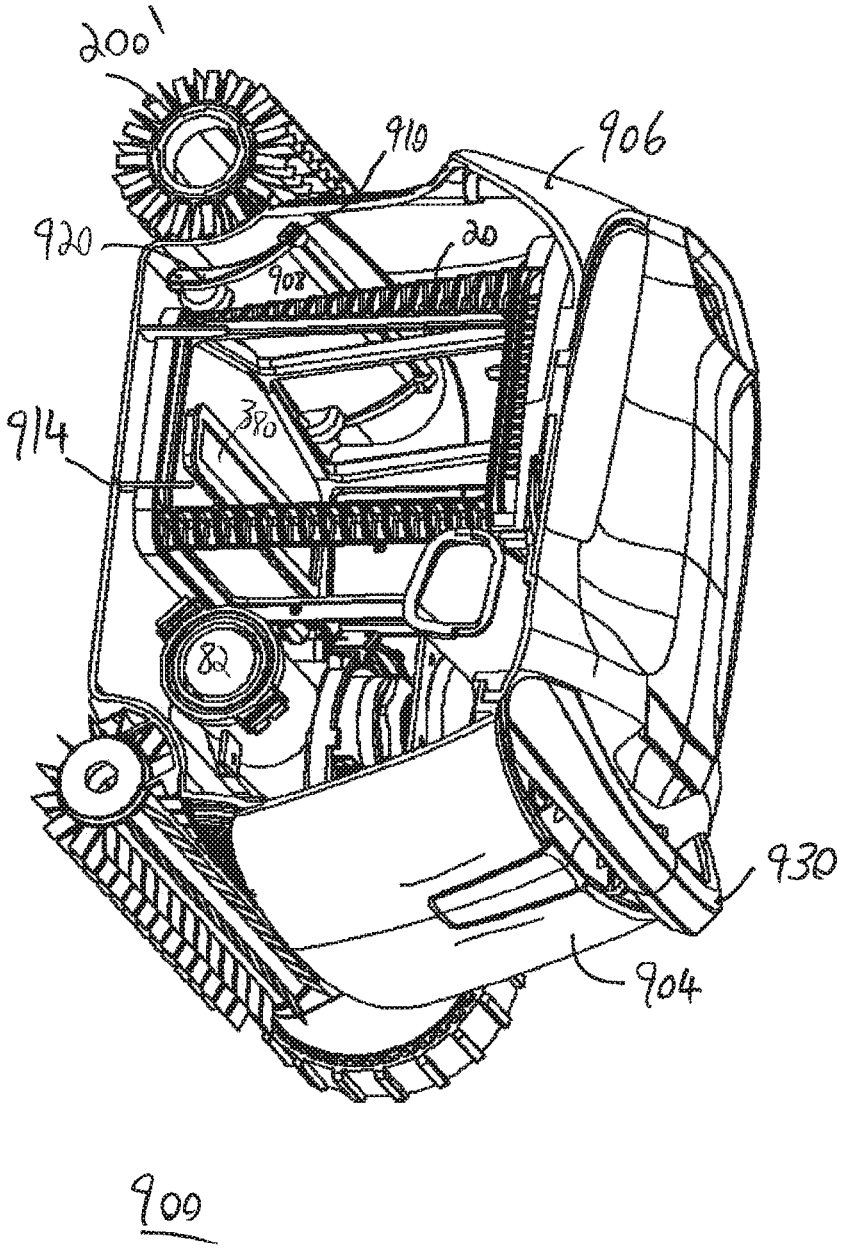
Figure 24:
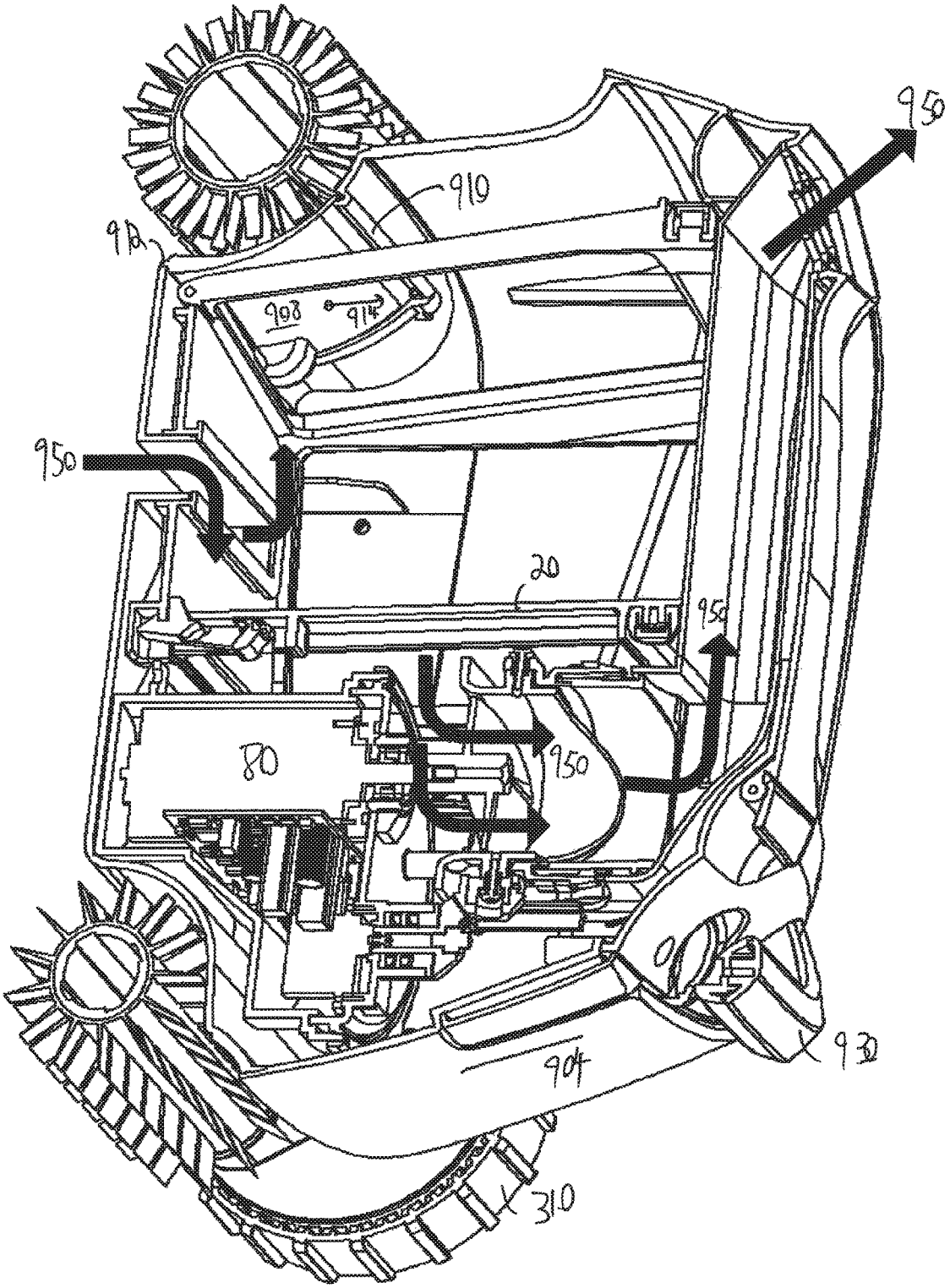
Figure 25:
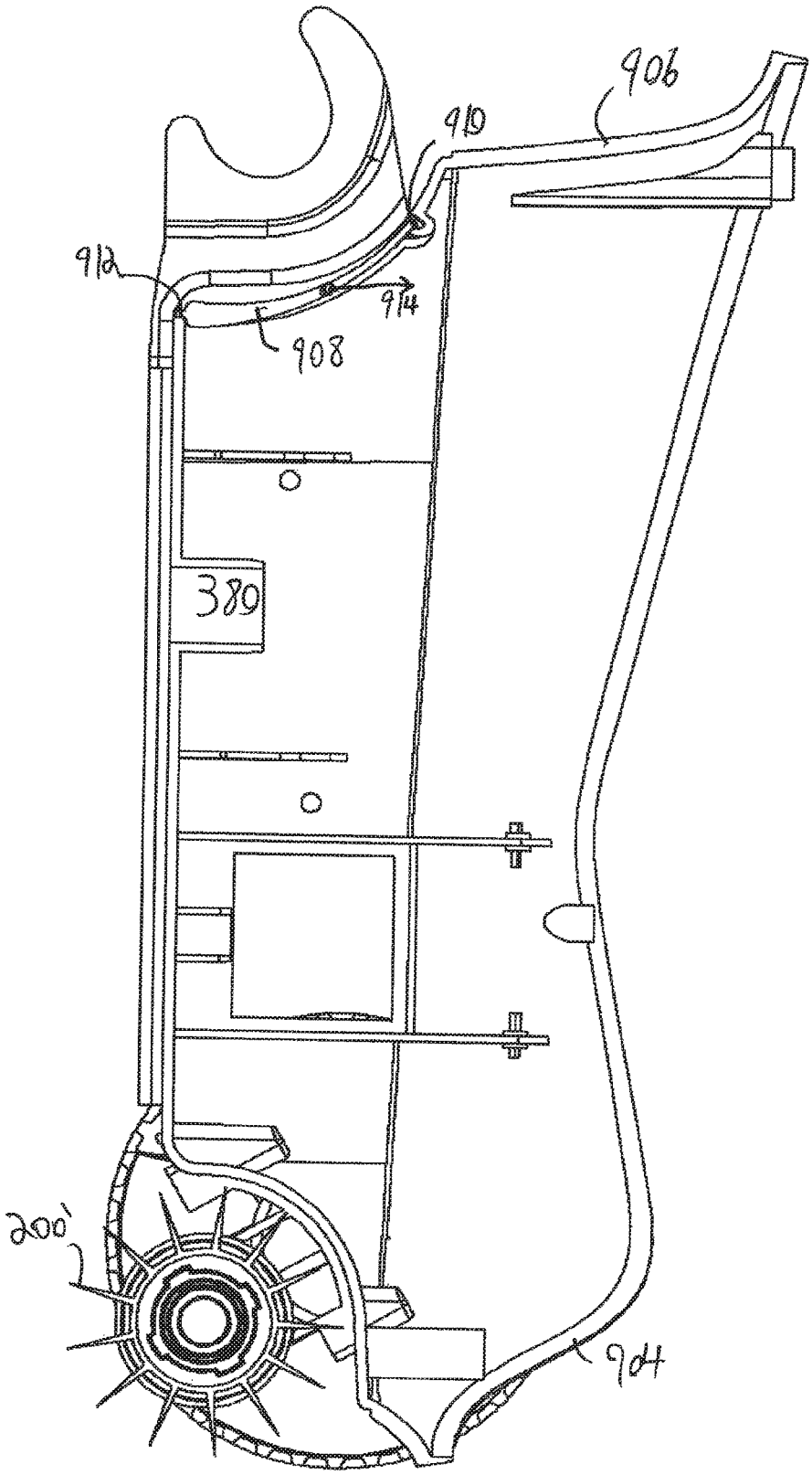
FIGS. 25-26 illustrate a portion of a cleaning robot according to various embodiment of the invention.
Figure 26:
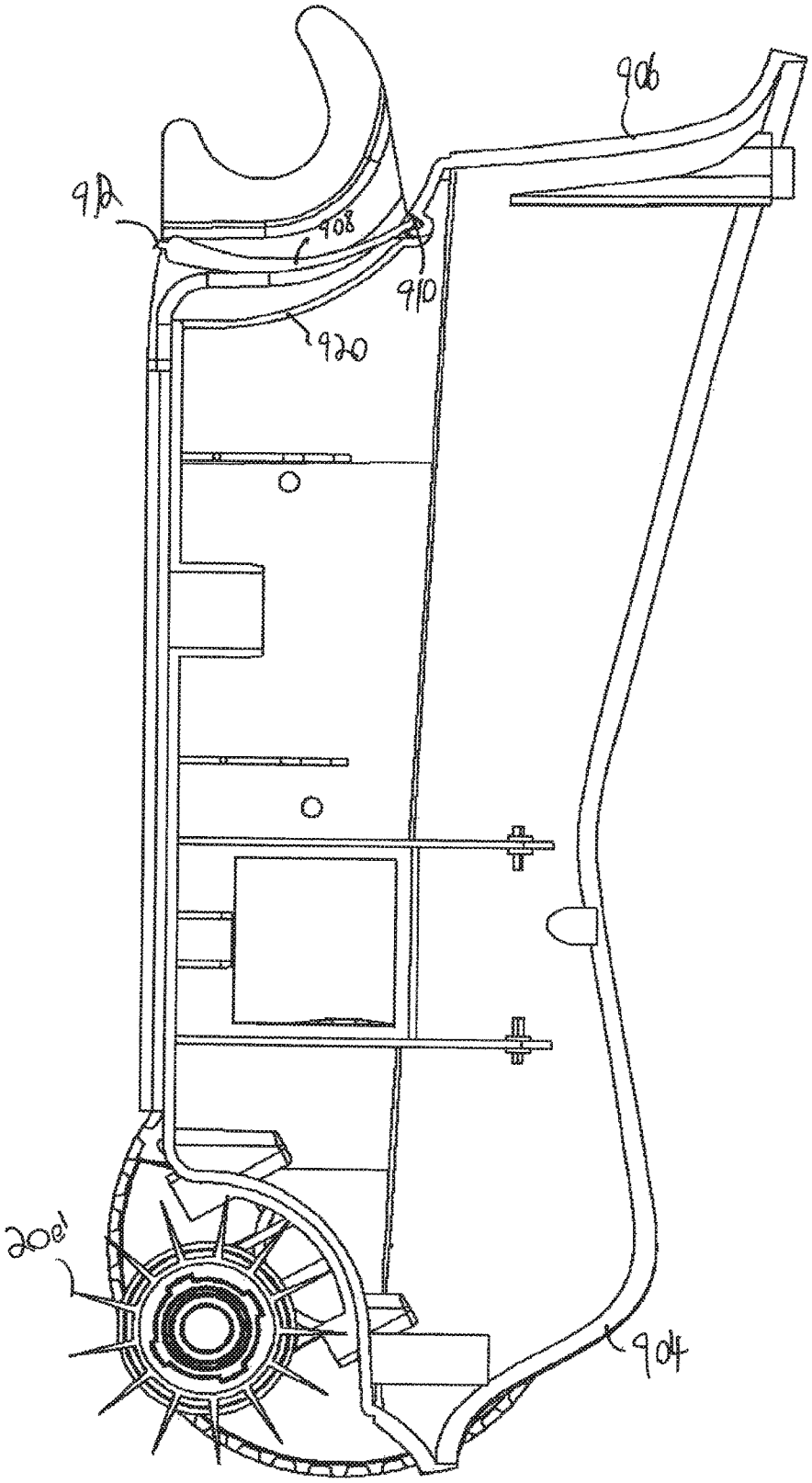

FIGS. 22-24 illustrate a cleaning robot 900 according to various embodiments of the invention. FIG. 25-26 illustrate a portion of the cleaning robot 900 according to various embodiment of the invention. FIGS. 22-25 illustrate a door 908 of the cleaning robot 900 at a closed position while FIG. 26 illustrates the door 908 at an opened position. FIG. 22 is a cross sectional view of the cleaning robot 900 taken about the center of the cleaning robot 900 while FIG. 23 is a cross sectional view taken along an virtual axis that is proximate to a left edge of the housing 902 of the cleaning robot 900. FIG. 24 illustrates the flow (via arrows 950) of fluid through the cleaning robot 900. FIGS. 25-26 illustrates parts of a housing 902 and the door 908.

These figures illustrate a mechanism that allows draining fluid through a rear opening of a cleaning robot once the robot is pulled out from the fluid—and also allows the rear opening to be sealed when the robot is submerged in fluid. The selective sealing of the rear opening can be obtained by rotational movement of a door. The opening and sealing can be obtained by using a floating element and without mechanical means (such as springs or other elastic elements) to force the door to seal the rear opening. This is expected to increase the life span of the cleaning robot and simplify its maintenance as springs tend to malfunction. Another advantage of the invention, in relation to a spring mechanism, is that the normal rear door position, when out of water with cleaner in a horizontal position e.g.: for storage or hibernation, will always remain open. This reduces the risk of a rear door becoming stuck or glued to the opening 920 as the gravity acts the opposite to flotation 914

Cleaning robot 900 can include any combination of any of the components listed in any of the previous figures.

The cleaning robot 900 may include: a housing 902 having a front portion 904, a rear portion 906, a door 908 and a hinge 910.

FIGS. 22-24 also show other elements of the cleaning robot 900 such as filtering unit 20, impeller 70, pump motor 80, drive motor (denoted 82 of FIG. 23), aperture 380, front and rear brushing units 200 and 200' and right track 310.

The door 908 is pivotally connected to the rear portion 906 of the housing 902 via the hinge 910. The upper edge of the door 908 can be connected to the hinge 910 in a manner that allows a rotational movement of the door 908 in relation to the hinge 910.

The rear portion 906 of the housing 902 may include a rear opening 920.

The door 908 is arranged to move between (a) a closed position in which the door 908 substantially closes the rear opening 920 and (b) an open position in which the door 908 does not close the rear opening 920.

The door 908 may include a floating element (for example—it may be in itself the floating element) or may be coupled to a floating element.

The floating element 912 is positioned to induce the door 908 to move to the closed position when the cleaning robot is submerged in fluid.

Assuming that a rotational movement of the door in a counterclockwise manner will induce the door to be at a closed position then the floating element is positioned to induce a counterclockwise movement. When looking from top of the cleaning robot 900—when the door is at the closed position the floating element 912 may be positioned between the hinge 910 and the front portion 904 of the housing 902.

Accordingly—at least a portion of the floating element 912 may be closer to the front portion of the housing than the hinge.

If the door 908 includes the floating element 910 then a center of flotation of the door 908 may be closer to the front portion 904 of the housing 902 than the hinge 910.

If the door 908 is coupled to the floating element 912 then a center of flotation 914 of a combination of the door 908 and the floating element 912 is closer to the front portion 904 of the housing 902 than the hinge 910.

The door 908 can be made of a floating material.

The door 908 may be induced to move to an open position when the cleaning robot is pulled out from the fluid and the front portion 904 of the housing 900 is positioned above the rear portion 906 of the housing 902.

The cleaning robot 900 may include a limiting element for limiting an extent of movement of the door between the open and closed positions.

The limiting element may be the rear brushing unit 200'.

The limiting element (not shown) may be arranged to limit a movement of the hinge 910. The range of movement of the door 908 between the open and closed positions may not exceed ten centimeters. Alternatively, it may exceed ten centimeters. The door movement can be limited so when immersed in the water at horizontal position the door center of flotation will be between the hinge and the front (904).

According to an embodiment of the invention that the center of floating 914 can be positioned between hinge 910 and front portion 904 and not on the opposite side.

The range of movement of the door 908 between the open and closed positions may not exceed one, two or three centimeters.

The door 908 may have a curved cross section.

The width of the door 908 may exceed a predetermined portion of a width of the cleaning robot 900. The predetermined portion may be any percentage. Both widths are measured along a horizontal axis when the cleaning robot 900 is placed at a horizontal position.

The cleaning robot 900 may also include handle 930 that is connected to the front portion 904 of the housing 900.

Figure 27:
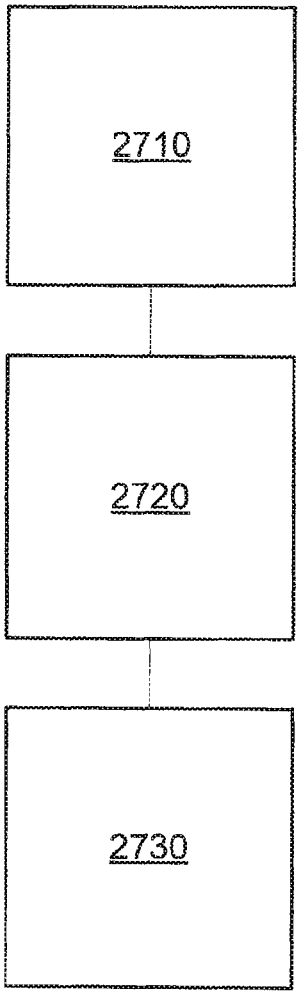
FIG. 27 illustrates a method according to an embodiment of the invention.

FIG. 27 illustrates a method 2700 according to an embodiment of the invention. Method 2700 includes stage 2710 of inserting a cleaning robot into a pool that is at least partially filled with fluid. The cleaning robot can be any of the cleaning robots illustrate din any one of FIGS. 1-26.

Stage 2710 is followed by stage 2720 of activating the cleaning robot. The activating may include, for example, allowing the cleaning robot to move and to clean the pool in any manner mentioned in any one of FIGS. 1-26.

Stage 2720 may include, for example:

i. Converting a rotary movement induced by a drive motor to a combination of (a) a rotary movement of the brushing element about a brushing element axis, and (b) a reciprocal movement of the brushing element in parallel to the brushing element axis.

ii. Converting the rotary movement induced by the drive motor to the reciprocal movement.

iii. Allowing the rotary movement to occurs within a rotary movement plane that is oriented in relation to the brushing element axis; wherein the converting is executed by a converter that may include: (a) a first interface that has a non-flat surface and is arranged to be rotated by the rotary movement: (b) a second interface that is positioned at fixed distance from the rotary movement plane; wherein the second interface is arranged to contact the second interface and force the first interface to reciprocate as a result of the rotary movement.

iv. Facilitating a reciprocal movement of the first interface and the brushing element in relation to the rotating element; whereas a rotation of the rotating element about the brushing element axis forces the first interface and the brushing element to rotate, in coordination with the rotating element, about the brushing element axis.

v. Introducing an imbalance between at least two movable elements of the cleaning robot, the imbalance results in a change in a direction of propagation of the cleaning robot, the imbalance may be induced as a result of at least one out of (a) a movement of a nozzle that is arranged to output fluid from the cleaning robot, and (b) a movement of a diaphragm that is coupled to the housing.

vi. Changing the position of the diaphragm in response to a change in an operational mode of an impeller of the cleaning robot.

vii. Allowing the diaphragm to be drawn towards the impeller when the impeller is rotated at a first rotational direction.

viii. Converting by a diaphragm transmission a change in a location of the diaphragm to a change in an elevation of a protrusion that once located at a low protrusion position extends below any of the multiple movable elements and induces the imbalance between the at least two movable elements.

ix. Inducing imbalance due to a movement of a nozzle that is arranged to rotate about an axis and thereby change a direction of fluid being outputted from the cleaning robot.

x. Converting a change in a location of the nozzle to a change in an elevation of a protrusion that once located at a low position contacts the surface of the pool and induces the imbalance between the at least two movable elements.

xi. Introducing an imbalance between at least two movable elements by detaching at least one of the at least two movable elements from the surface of the pool.

xii. Introducing the imbalance by a protrusion that is arranged to introduce the imbalance by moving to a position in which it contacts a surface of the pool and causes at least one of the movable elements to be spaced apart from the surface of the pool.

xiii. Rotating a nozzle about an nozzle axis such as to alter an orientation of the nozzle in relation to an imaginary longitudinal axis of the housing.

xiv. Directing fluid from the nozzle (a) towards the central fluid conduit when the nozzle is at a first orientation, (b) towards the right fluid conduit when the nozzle is at a second orientation, and (c) towards the left fluid conduit when the nozzle is at a third orientation; wherein the first orientation differs from the second and third orientations.

xv. Directing the fluid wherein the second orientation differs from the third orientation.

xvi. Directing the fluid wherein the second orientation substantially equals the third orientation and wherein a selection between the left fluid conduit and the right fluid conduit is responsive to a rotation of the nozzle towards the second orientation.

xvii. Directing the fluid wherein the second orientation substantially equals the third orientation and wherein a selection between the left fluid conduit and the right fluid conduit is responsive to an operational mode of the impeller.

xviii. Directing the fluid wherein the second orientation substantially equals the third orientation and wherein the fluid interfacing unit comprises a shutter that is arranged to prevent fluid from entering the right fluid conduit when positioned at a first position and is arranged to prevent fluid from entering the left fluid conduit from entering the right fluid conduit when positioned at a second position.

xix. Moving the nozzle towards the second orientation in order to move the shutter between the first and second positions.

xx. Positioning the nozzle at a fourth orientation; wherein when in either one of the first and fourth orientations the nozzle faces the center opening.

xxi. Moving the cleaning robot wherein the pump motor, the drive motor and the impeller are substantially closer to a front edge of the housing than to a rear edge of the housing.

xxii. Moving the cleaning robot while determining a motion characteristic or a location characteristic of the cleaning robot in response to an outcome of (a) illuminating, by at least one light source an area of a surface of the pool being cleaned by the cleaning robot through optical lens at a non vertical angle, (b) and generating, by a detector, based upon light from the area of the surface of the pool, detection signals indicative of a motion of the cleaning robot; (c) receiving the detection signals and determining the motion characteristic or the location characteristic of the cleaning robot.

xxiii. Generating, by a first compass first directional information; generating by a second compass second directional information; wherein the first and second compasses are spaced apart from each other; receiving directional information from the first and second compasses, and determining at least one of a location parameter and a directional parameter of the cleaning robot based upon at least the first and second directional information.

xxiv. The generating may include comparing the first and second directional information to provide a comparison result; and determining a validity of at least one of the first and second directional information based upon the comparison result.

xxv. Declaring the first directional information as valid if a difference between the first and second results is below a threshold.

xxvi. Declaring the first directional information and the second directional information as invalid if a difference between the first and second results exceeds a threshold.

xxvii. Generating output signals indicative of a direction of the cleaning robot by a non-magnetic sensor and assigning more weight to output signals of the non-magnetic sensor than to the first and second directional information if it is determined that a difference between the first and second results exceeds a threshold.

xxviii. Converting a rotary movement induced by the drive motor to a combination of (a) a rotary movement of the brushing element about a brushing element axis, and (b) vibrations of the brushing element, the vibrations differ from the rotary movement.

xxix. Filtering fluid by a first filter of a filtering unit that and the filtering fluid filtered by the first filter by a second filter of the filtering unit, wherein the filtering unit comprises a first filter that has a first filtering level and a second filter that has a second filtering level that differs from the first filtering level.

xxx. Allowing a door (that is pivotally connected to a rear portion of a housing of a cleaning robot, the housing has a rear opening), to move between a closed position in which the door substantially closes the rear opening and an open position in which the door does not close the rear opening; wherein the door comprises a floating element or is coupled to a floating element, wherein the floating element is positioned and shaped to induce the door to move to the closed position when the cleaning robot is submerged in fluid and to remain in an open position when out of water in a horizontal position.

xxxi. Allowing the door to move between a closed position in which the door substantially closes the rear opening and an open position in which the door does not close the rear opening; wherein the door comprises a floating element or is coupled to a floating element, wherein the floating element is positioned and shaped to induce the door to move to the closed position when the cleaning robot is submerged in fluid.

Stage 2720 may be followed by stage 2730 of taking the cleaning robot from the pool.

LIST OF ELEMENTS a. Cleaning robot 10.
b. Cover 11
c. Main body 12.
d. Housing 13.
e. Rear panel 14
f. Right sidewall 15
g. Bottom panel 16.
h. Filtering unit 20.
i. First filter 21.
j. Second filter 22.
k. Impeller 70.
l. Pump motor 80.
m. Drive motor 82.
n. Spur 84.
o. Fluid surface 90
p. Front brushing unit 200.
q. Rear brushing unit 200'.
r. First interface 202.
s. Second interface 201.
t. Brushing element 211.
u. Rotating element 212.
v. Radially extending protrusions 212'.
w. Cylindrical bearing 213.
x. Brushing element axel 214.
y. Track receiving portion 220.
z. Brushing element 240.
aa. Brushing element 250.
bb. Interfacing elements 260, 270.
cc. Inner edges of interfacing elements 261, 271
dd. Outer edges of interfacing elements 262, 272
ee. Springs 280.
ff. Diaphragm 300.
gg. Aperture 302.
hh. Right track 310.
ii. Left track 312.
jj. Rear right wheel 320.
kk. Rear left wheel 322.
ll. Diaphragm transmission 330.
mm. Handle 332.
nn. First radially extending element 333.
oo. Diaphragm axle 334.
pp. Curved clips 336.
qq. Second radially extending element 338.
rr. Protrusion 350.
ss. Spring 352.
tt. Disk 353.
uu. Disk 354.
vv. First vertical inner wall 360.
ww. Second vertical inner wall 362.
xx. Nozzle 410.
yy. Nozzle transmission 420.
zz. Radially extending element 423.
aaa First fin 425.
bbb. Second fin 424.
ccc. Cylindrical interfacing element 426.
ddd. Nozzle axle 442.
eee. Curved clip 441.
fff. Nozzle axle 442.
ggg. Multiple opening cover portion 450.
hhh. Right opening 452.
iii. Left opening 454.
jjj. Central opening 456.
kkk. Right fluid conduit 462.
lll. Opening 462' formed in the right fluid conduit 462.
mmm. Left fluid conduit 464.
nnn. Opening 464' formed in the left fluid conduit 464.
ooo. Central fluid conduit 466.
ppp. Vertical bevel gear 502.
qqq. Horizontal bevel gear 504
rrr. Removable cover 506 of a sealed housing.
sss. Shutter 550.
ttt. Curved cover 560.
uuu. Front edge 601 of the housing.
vvv. Rear edge 604 of the housing.
www. Spur 610.
xxx. Longitudinal axis 701.
yyy. Traverse axis 702.
zzz. Multiple opening structures 720.
aaaa. Right aperture 724.
bbbb. Left aperture 723.
cccc. Upper aperture 722.
dddd. Rear aperture 721.
eeee. Optical detector 800.
ffff. Radiation source 801
gggg. Detector 802
hhhh. Optics 803
iiii. Detection signal processor 804.
jjjj. First compass 810.
kkkk. Second compass 820.
llll. Processor 830.
mmmm. Non-magnetic sensor 840.
nnnn. Cleaning robot 900.
oooo. Housing 902.
pppp. Front portion 904.
qqqq. Rear portion 906.
rrrr. Door 908.
ssss. Hinge 910.
tttt. Floating element 912.
uuuu. Center of floatation 914
vvvv. Rear opening 920.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "rear" "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Although specific conductivity types or polarity of potentials have been described in the examples, it will appreciated that conductivity types and polarities of potentials may be reversed.

Those skilled in the art will recognize that the boundaries between various components are merely illustrative and that alternative embodiments may merge various components or impose an alternate decomposition of functionality upon various components. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" Each other such that the desired functionality is achieved, irrespective of architectures or intermedial components. Likewise, any two components so associated can also be viewed as being "operably connected," or "operably coupled," to Each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps than those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A cleaning robot comprising:

a housing having a front portion, a rear portion, a door and a hinge; wherein the door is pivotally connected to the rear portion of the housing via the hinge;

wherein the rear portion comprises a rear opening;

wherein the door is arranged to move between a closed position in which the door substantially closes the rear opening and an open position in which the door does not close the rear opening;

wherein the door comprises a floating element or is coupled to a floating element, wherein the floating element is positioned and shaped to induce the door to move to the closed position when the cleaning robot is submerged in fluid and to remain in an open position when the cleaning robot is out of a pool and is positioned in a horizontal position.

2. The cleaning robot according to claim 1, wherein at least a portion of the floating element is closer to the front portion of the housing than the hinge.

3. The cleaning robot according to claim 1, wherein a center of flotation of the door is closer to the front portion of the housing than the hinge.

4. The cleaning robot according to claim 1, wherein the door is coupled to the floating element and wherein a center of flotation of a combination of the door and the floating element is closer to the front portion of the housing than the hinge.

5. The cleaning element according to claim 1, wherein the door is made of a floating material.

6. The cleaning robot according to claim 1, wherein the door is induced to move to an open position when the cleaning robot is pulled out from the fluid and the front portion of the housing is positioned above the rear portion of the housing.

7. The cleaning robot according to claim 1 further comprising a limiting element for limiting an extent of movement of the door between the open and closed positions.

8. The cleaning robot according to claim 7 wherein the limiting element is a rear cleaning unit.

9. The cleaning robot according to claim 7 wherein the limiting element is arranged to limit a movement of the door.

10. The cleaning robot according to claim 1 wherein a range of movement of the door between the open and closed positions does not exceed ten centimeters.

11. The cleaning robot according to claim 1 wherein a range of movement of the door between the open and closed positions does not exceed a centimeter.

12. The cleaning robot according to claim 1 wherein the door has a curved cross section.

13. The cleaning robot according to claim 1, wherein a width of the door exceeds half a width of the cleaning robot.

14. The cleaning robot according to claim 1, wherein a width of the door exceeds one fourth of a width of the cleaning robot.

15. The cleaning robot according to claim 1 further comprising a handle that is connected to the front portion of the housing.

16. The cleaning robot according to claim 1 wherein the door is coupled to the rear portion of the housing only by the hinge.

17. The cleaning robot according to claim 1 comprising a drive motor that is arranged to rotate multiple rotating element, at least some of which are arranged to contact a surface of the pool; an impeller; a pump motor that is arranged to rotate the impeller; a filtering unit; and a brushing element; wherein the pump motor, the drive motor and the impeller are substantially closer to the front portion of the housing than to a rear portion of the housing.

18. The cleaning robot according to claim 17, wherein a distance of each one of the pump motor, drive motor and the impeller from the front portion of the housing is at least 20% smaller than a corresponding distance to the rear portion of the housing.

19. A housing for a cleaning robot, the housing comprises:

a front portion, a rear portion, a door; and a hinge;

wherein the door is pivotally connected to the rear portion via the hinge;

wherein the rear portion comprises a rear opening;

wherein the door is arranged to move between a closed position in which the door substantially closes the rear opening and an open position in which the door does not close the rear opening;

wherein the door comprises a floating element or is coupled to a floating element, wherein the floating element is positioned and shaped to induce the door to move to the closed position when the cleaning robot is submerged in fluid.

* * * * *